US007825863B2

(12) United States Patent
Martiskainen et al.

(10) Patent No.: US 7,825,863 B2
(45) Date of Patent: Nov. 2, 2010

(54) COMPACT ANTENNA

(75) Inventors: Matti Martiskainen, Tiberias (IL); Daniel Cho, Kyung Ki-Do (KR); Steve Krupa, Cambridge (GB); Snir Azulay, Tiberias (IL); Yona Haim, Tiberias (IL)

(73) Assignee: Galtronics Ltd., Tiberias (IL)

( * ) Notice: Subject to any disclaimer, the term of this patent is extended or adjusted under 35 U.S.C. 154(b) by 516 days.

(21) Appl. No.: 11/940,959

(22) Filed: Nov. 15, 2007

(65) Prior Publication Data

US 2008/0180333 A1 Jul. 31, 2008

Related U.S. Application Data

(60) Provisional application No. 60/859,629, filed on Nov. 16, 2006.

(51) Int. Cl.
*H01Q 1/24* (2006.01)

(52) U.S. Cl. ..... 343/702; 343/700 MS

(58) Field of Classification Search ..... 343/700 MS, 343/702, 833, 846, 848, 895
See application file for complete search history.

(56) References Cited

U.S. PATENT DOCUMENTS

| | | | | |
|---|---|---|---|---|
| 6,081,242 | A | 6/2000 | Wingo | |
| 6,366,243 | B1 | 4/2002 | Isohatala et al. | |
| 6,538,607 | B2 | 3/2003 | Barna et al. | |
| 6,611,235 | B2 | 8/2003 | Barna et al. | |
| 6,856,294 | B2 | 2/2005 | Kadambi et al. | |
| 6,917,335 | B2 | 7/2005 | Kadambi et al. | |
| 6,956,534 | B2 | 10/2005 | Hagiwara et al. | |
| 7,053,844 | B2 | 5/2006 | Gaucher et al. | |
| 7,084,813 | B2 | 8/2006 | Pathak et al. | |
| 7,088,299 | B2 | 8/2006 | Siegler et al. | |
| 7,136,019 | B2 | 11/2006 | Mikkola et al. | |
| 7,170,450 | B2 * | 1/2007 | Chang et al. | 343/700 MS |
| 7,183,982 | B2 | 2/2007 | Kadambi et al. | |
| 7,319,432 | B2 * | 1/2008 | Andersson | 343/702 |
| 7,701,401 | B2 * | 4/2010 | Suzuki et al. | 343/702 |
| 2003/0103010 | A1 | 6/2003 | Boyle | |
| 2003/0201942 | A1 | 10/2003 | Poilasne et al. | |
| 2004/0090366 | A1 | 5/2004 | Wong et al. | |
| 2005/0184914 | A1 | 8/2005 | Ollikainen et al. | |
| 2007/0229358 | A1 | 10/2007 | Chi et al. | |
| 2008/0309562 | A1 * | 12/2008 | Tsutsumi et al. | 343/700 MS |
| 2009/0189815 | A1 * | 7/2009 | Hotta et al. | 343/700 MS |

FOREIGN PATENT DOCUMENTS

| | | |
|---|---|---|
| FI | 114260 | 9/2004 |
| WO | 2004027922 | 4/2004 |
| WO | WO-2004/027922 | 4/2004 |

OTHER PUBLICATIONS

U.S. Appl. No. 60/859,629.
H. Soutome, et al., "A wide bandwidth monopole antenna using a human-body as a ground plane", The Institue of Electronics, Information and Communication Engineers, IEICE Technical Report SR2005-44 (Jul. 2005)—an English abstract.

* cited by examiner

*Primary Examiner*—Tan Ho
(74) *Attorney, Agent, or Firm*—Fish & Richardson P.C.

(57) ABSTRACT

An antenna, including a planar dielectric substrate and a conductive ground plane formed on the substrate. A conductive monopole is formed on the substrate and has an end point located in proximity to a feed region of the ground plane. A conductive coupling element is formed on the substrate and is coupled to the ground plane at a coupling region of the ground plane. The coupling element is folded around the monopole.

66 Claims, 19 Drawing Sheets

SIDE VIEW

COMPACT ANTENNA

CROSS-REFERENCE TO RELATED APPLICATION

This application claims the benefit of U.S. Provisional Patent Application 60/859,629, filed 16 Nov. 2006, which is incorporated herein by reference.

FIELD OF THE INVENTION

The present invention relates generally to antennas, and specifically to antennas that may be used in multiple bands.

BACKGROUND OF THE INVENTION

As the size of communication devices, such as cellular telephones, is reduced, typically the size of the antenna is required to be reduced as well. However, basic properties of the antenna may limit the freedom that a designer has to reduce the size of the antenna without adversely affecting the overall antenna performance. A paper titled "Introduction to Ultra-Wideband Antennas," by Schantz, presented at the IEEE Conference on Ultra Wideband Systems and Technologies, November, 2003, describes some of the limitations that the author believes may hold for antennas. The paper is incorporated herein by reference.

The effect of a chassis to which the antenna is coupled is evaluated in a paper titled "Resonator-Based Analysis of the Combination of Mobile Handset Antenna and Chassis," by Vainikainen et al., published in IEEE Transactions on Antennas and Propagation, Vol. 50, No. 10, October, 2002. The paper is incorporated herein by reference.

Finnish Patent Fl 114260 B, to Vainikainen et al., which is incorporated herein by reference, describes a coupling device for sending or receiving RF signals. The patent describes an antenna using radiation from a ground plane.

In a paper titled "Thin dual-resonant stacked shorted patch antenna for mobile communications," by Ollikainen et al., published in Electronic Letters Volume 35, number 6, in March, 1999, the authors describe an antenna constructed from two stacked patches. The paper is incorporated herein by reference. One of the patches is a driven element, while the other acts as a parasitic element. The driven patch is formed on one side of a 1.6 mm substrate, on the other side of which is formed a ground plane. The parasitic patch is stacked above the driven patch, making the total height of the antenna 4 mm.

U.S. Patent Application 2003/0201942 A1, to Poilasne et al., which is incorporated herein by reference, describes a multi-band antenna. The antenna comprises one or more first plates and one or more second plates. The plates are mounted over a ground plate.

In a paper titled "A Low-Profile Antenna Solution for Mobile Phones with GSM, UMTS and WLAN Operation," by Rennings et al., presented at the European Microwave Conference, Paris, France in October, 2005, the authors describe an antenna formed by printing dual-layers on a substrate. The paper is incorporated herein by reference.

In a paper titled "Low-Profile Planar Monopole Antenna for GSM/DCS/PCS Triple-Band Mobile Phone," by Lee et al., and published in the IEEE Antennas and Propagation Society International Symposium 2002, Volume 3, pages 26-29, the authors describe an antenna printed on a substrate. The paper is incorporated herein by reference. The antenna has a single feed point with a microstrip feed line.

PCT Patent Application WO 2004/027922, to Kadambi et al., which is incorporated herein by reference, describes an antenna which may be printed on a substrate. The antenna is connected to one region of a ground plane on the substrate.

SUMMARY OF THE INVENTION

In an embodiment of the present invention, an antenna comprising at least two elements is formed on a planar dielectric substrate, and a conductive ground plane is also formed on the same substrate. A first element of the antenna comprises a monopole, which is located on the substrate so as to have one of its end points, herein termed the feed end point, in proximity to a feed region of the ground plane. The feed end point and feed region form a feed zone for the antenna. Typically, the monopole is in the form of a linear or folded or meandering conductive flat strip, and the length of the strip is arranged so that the impedance of the monopole is substantially capacitive. The monopole may be a single-band monopole or a multi-band monopole.

A second element of the antenna, herein termed a coupling element, comprises a conductive strip, which is formed on the substrate and which is folded around the monopole. The coupling element may be formed so as to have a length that is at least 1.5 times the length of the monopole. Typically, the length of the coupling element is twice or more the length of the monopole. The coupling element is connected galvanically or capacitively to a coupling region of the ground plane, which is typically a different region from the feed region of the ground plane.

The monopole, in conjunction with the coupling element and the ground plane, radiates efficiently in a high-frequency band. In addition, the monopole couples a low-frequency band electric field, via the coupling element, to the ground plane, which radiates efficiently at the low-frequency band. The coupling by the coupling element occurs mainly via the electric field, which is strong at edge regions of the ground plane. The coupling element, by virtue of folding around the monopole and being coplanar with the monopole and the ground plane, does not radiate. Typically, the widest possible overall bandwidth of the combined structure of monopole, coupling element, and ground plane is determined mainly by the size of the ground plane, and a center frequency of the combined structure is determined mainly by the length of the coupling element in conjunction with the resonance frequency of the ground plane. A narrow bandwidth of the coupling element does not prevent wide band operation, if the center frequencies of the coupling element and the ground plane are relatively close together. The combined structure may thus be conveniently configured to form a very good antenna for both the low and the high-frequency bands. Furthermore, the monopole and the coupling element may be laid out extremely compactly in a planar form and may be produced at very low cost, simply by removal of conductive material from one or both outer surfaces of the substrate.

In one embodiment one or more reactive devices may be connected to the monopole and/or the coupling element, so as to alter the electrical length of the elements.

In an alternative embodiment the monopole and the coupling element may be on opposite surfaces of the substrate.

In some embodiments, the monopole, the coupling element, and the ground plane, are on one common surface of the substrate.

Both the feed region and the coupling region are typically close to a common edge of the ground plane. Alternatively, one or both of the regions may be indented from the edge, in which case the monopole and/or the coupling element may be correspondingly extended. In a disclosed embodiment, a length of an indentation, and of a corresponding section of the coupling element within the indentation, is adjusted to improve performance of the antenna by reducing the antennas reflection coefficient. In some disclosed embodiments, the indentation is configured to have more than one direction, for example by being formed in the shape of an "L," the different directions providing control for directions of polarization of radiation from the antenna. The polarization may be further controlled by selecting whether the section of the coupling element galvanically or capacitively couples to the ground plane. Alternatively or additionally, polarization may be controlled by locating the coupling region along an edge of the ground plane different from the edge close to the feed region.

In an alternative disclosed embodiment, the antenna comprises one or more further coupling elements in addition to the coupling element described above. Each of the further elements is coupled to a respective region of the ground plane. In these alternative embodiments, the length of the monopole is arranged to be too short to radiate efficiently, and acts mainly to couple electric or magnetic fields via the coupling elements to the ground plane, which has dimensions chosen to enable it to radiate efficiently. For example, in the case of one further coupling element, the length of the original coupling element may be selected so that it enables efficient radiation from the ground plane at a high-frequency band, and the length of the further coupling element may be selected so that it enables efficient radiation from the ground plane at a low-frequency band.

There is therefore provided, according to an embodiment of the present invention, an antenna, including:

a planar dielectric substrate;

a conductive ground plane formed on the substrate;

a conductive monopole formed on the substrate and having an end point located in proximity to a feed region of the ground plane; and a conductive coupling element formed on the substrate and coupled to the ground plane at a coupling region of the ground plane, the coupling element being folded around the monopole.

Typically, the conductive monopole has a monopole length, and the conductive coupling element has a coupling element length equal to at least 1.5 times the monopole length. In an embodiment the coupling element length is equal to at least two times the monopole length.

The monopole and the coupling element may be configured so that the monopole together with the ground plane radiate with an efficiency of 30% or more in a first frequency band having a first center frequency and in a second frequency band having a second center frequency. The first and second frequency bands may be disjoint. In one embodiment the first frequency band includes frequencies between 820 MHz and 960 MHz, and the second frequency band includes frequencies between 1.7 GHz and 2.2 GHz.

The monopole and the coupling element may be configured so that the monopole together with the ground plane radiate with an efficiency of at least 30%.

The monopole and the coupling element may be configured so that the monopole together with the ground plane radiate with an efficiency of at least 30% at a frequency less than or equal to 6 GHz.

Typically, at least one of the conductive monopole and the conductive coupling element includes a flat strip.

In some embodiments, the antenna includes one or more reactive elements electrically connected to at least one of the conductive monopole and the conductive coupling element. The one or more reactive elements may be electrically connected between the conductive coupling element and the ground plane.

In a disclosed embodiment, the monopole and the coupling element are formed on opposite surfaces of the substrate.

The ground plane may include a first ground plane section formed on a first surface of the substrate and a second ground plane section formed on a second surface of the substrate.

The ground plane may include an indentation, and the feed region may be located in proximity to the indentation.

In one embodiment the ground plane includes an indentation, and a section of the coupling element is disposed within the indentation so as to couple electrically to an end point of the indentation. The indentation and the section of the coupling element may be linear. A length of the indentation and of the section may be selected so as to optimize at least one of a reflection coefficient and a radiation efficiency of the antenna at a selected frequency. Alternatively, the indentation and the section of the coupling element may be non-linear. The indentation may include a first indentation section having a first direction and a second indentation section having a second direction different from the first direction, and the section of the coupling element may include a first coupling element section disposed within the first indentation section and a second coupling element section disposed within the second indentation section. One of the first indentation section and the first coupling element section may have a first dimension, and one of the second indentation section and the second coupling element section may have a second dimension, and the first and the second dimensions may be selected so as to determine a polarization characteristic of radiation from the antenna.

Typically, the coupling element is coupled capacitively to the ground plane.

Alternatively, the coupling element is coupled galvanically to the ground plane.

The antenna may include a further conductive coupling element formed on the substrate and connected to the ground plane at a further coupling region. The conductive coupling element may have a coupling element length, and the further conductive coupling element may have a further coupling element length, and the coupling element length and the further coupling element length may be selected so that the coupling element and the further coupling element radiate respectively in a first radiation frequency band and in a second radiation frequency band different from the first radiation frequency band. The conductive monopole may have a monopole length selected so that the folded monopole acts primarily to couple an electric field to the conductive coupling element and the further conductive coupling element.

In an alternative embodiment, the conductive ground plane, the conductive monopole, and the conductive coupling element are formed on one common surface of the substrate.

The coupling region and the feed region may be in different locations. The coupling region and the feed region may partly overlap.

The ground plane typically includes a ground plane edge, and at least one of the coupling region and the feed region may be in proximity to the ground plane edge. At least one of the coupling region and the feed region may be at least 3 mm from an end of the edge.

The ground plane may have a ground plane length and the monopole may have a monopole length, and a ratio between the monopole length and the ground plane length is in a range between 0.25 and 0.6.

The monopole may include a folded monopole, a meander monopole or a linear monopole.

The ground plane may include a first edge and a second edge different from the first edge, the feed region may be formed in proximity to the first edge and the coupling region may be formed in proximity to the second edge. The coupling element may include a linear element having a dimension selected so as to determine a polarization characteristic of radiation from the antenna.

In a disclosed embodiment the dielectric substrate includes a plurality of dielectric layers, and at least two of the ground plane, the monopole, and the coupling element are formed on different layers included in the dielectric layers.

The monopole may include a single-band monopole or a multi-band monopole.

The coupling element may include a further coupling element galvanically connected to the coupling element and capacitively coupling to a further coupling region of the ground plane.

Typically, the monopole as viewed from the feed region and the coupling element as viewed from the coupling region are configured to turn in opposite directions. Alternatively, the monopole as viewed from the feed region and the coupling element as viewed from the coupling region are configured to turn in like directions.

The end point may be configured to couple to a live side of a feed to the antenna.

The antenna may include a matching circuit coupled to the conductive monopole and located in proximity to the end point.

There is further provided, according to an embodiment of the present invention a method for producing an antenna, including:

providing a planar dielectric substrate;

forming a conductive ground plane on the substrate;

forming a conductive monopole on the substrate, the monopole having an end point located in proximity to a feed region of the ground plane;

forming a conductive coupling element on the substrate;

coupling the conductive coupling element to the ground plane at a coupling region of the ground plane; and folding the coupling element around the monopole.

There is further provided, according to an embodiment of the present invention an antenna, including:

a dielectric substrate;

a conductive ground plane formed on the substrate and having a first edge and a second edge;

a first conductive monopole formed on the substrate and having a first end point located in proximity to the first edge;

a first conductive coupling element formed on the substrate and coupled to the ground plane at a first coupling region of the ground plane, the first coupling element being folded around the first monopole;

a second conductive monopole formed on the substrate and having a second end point located in proximity to the second edge; and a second conductive coupling element formed on the substrate and coupled to the ground plane at a second coupling region of the ground plane, the second coupling element being folded around the second monopole.

Typically, the ground plane, the first monopole, and the first coupling element are configured to operate at a first frequency, and the ground plane, the second monopole, and the second coupling element are configured to operate at a second frequency different from the first frequency.

In one embodiment the ground plane, the first monopole, and the first coupling element, are configured to operate at a given frequency, and the ground plane, the second monopole, and the second coupling element are configured to operate at the given frequency.

There is further provided, according to an embodiment of the present invention a method for producing an antenna, including:

providing a dielectric substrate;

forming a conductive ground plane having a first edge and a second edge on the substrate;

forming a first conductive monopole on the substrate, the first monopole having a first end point located in proximity to the first edge;

forming a first conductive coupling element on the substrate;

coupling the first conductive coupling element to the ground plane at a first coupling region of the ground plane;

folding the first coupling element around the first monopole;

forming a second conductive monopole on the substrate, the monopole having a second end point located in proximity to the second edge;

forming a second conductive coupling element on the substrate;

coupling the second conductive coupling element to the ground plane at a second coupling region of the ground plane; and folding the second coupling element around the second monopole.

There is further provided, according to an embodiment of the present invention an antenna, including:

a planar dielectric substrate;

a conductive ground plane formed on the substrate and having a ground plane edge;

a conductive monopole formed on the substrate in proximity to the ground plane edge and having an end point located in proximity to a feed region of the ground plane; and a conductive coupling element formed on the substrate in proximity to the ground plane edge and coupled to the ground plane at a coupling region of the ground plane, the coupling element being configured so that a portion of the conductive monopole lies between a section of the element and the ground plane edge.

Typically, the feed region and the coupling region include respective sections of the ground plane edge.

In an embodiment at least one of the sections is at least 3 mm from an end of the edge.

There is further provided, according to an embodiment of the present invention a communication device, including:

a transceiver; and an antenna coupled to the transceiver, the antenna including:

a planar dielectric substrate;

a conductive ground plane formed on the substrate;

a conductive monopole formed on the substrate and having an end point located in proximity to a feed region of the ground plane; and a conductive coupling element formed on the substrate and coupled to the ground plane at a coupling region of the ground plane, the coupling element being folded around the monopole.

There is further provided, according to an embodiment of the present invention a method for producing a communication device, including:

providing a transceiver; and coupling an antenna to the transceiver, the antenna including:

a planar dielectric substrate, a conductive ground plane formed on the substrate, a conductive monopole formed on the substrate and having an end point located in proximity to a feed region of the ground plane, and a conductive coupling element formed on the substrate and coupled to the ground plane at a coupling region of the ground plane, the coupling element being folded around the monopole.

There is further provided, according to an embodiment of the present invention an antenna, including:

a planar dielectric substrate;

a conductive ground plane formed on the substrate;

a conductive loop formed on the substrate and having an end point located in proximity to a feed region of the ground plane; and a conductive coupling element formed on the substrate and coupled to the ground plane at a coupling region of the ground plane, the coupling element being folded around the loop.

There is further provided, according to an embodiment of the present invention a method for producing an antenna, including:

providing a planar dielectric substrate;

forming a conductive ground plane on the substrate;

forming a conductive loop on the substrate, the loop having an end point located in proximity to a feed region of the ground plane; and forming a conductive coupling element on the substrate and coupling the coupling element to the ground plane at a coupling region of the ground plane so that the coupling element folds around the loop.

There is further provided, according to an embodiment of the present invention an antenna, including:

a planar dielectric substrate;

a conductive ground plane formed on the substrate;

a conductive monopole having an end point located in proximity to a feed region of the ground plane; and a conductive coupling element coupled to the ground plane at a coupling region of the ground plane, at least one of the conductive monopole and the conductive coupling element having a section external to a plane of the substrate, a projection of the coupling element onto the plane being folded around a projection of the monopole onto the plane.

There is further provided, according to an embodiment of the present invention, a method for producing an antenna, including:

providing a planar dielectric substrate;

forming a conductive ground plane on the substrate;

forming a conductive monopole having an end point located in proximity to a feed region of the ground plane; and coupling a conductive coupling element to the ground plane at a coupling region of the ground plane, at least one of the conductive monopole and the conductive coupling element having a section external to a plane of the substrate, a projection of the coupling element onto the plane being folded around a projection of the monopole onto the plane.

There is further provided, according to an embodiment of the present invention, an antenna, including:

a planar dielectric substrate;

a conductive ground plane formed on the substrate and operative as a parallel resonant circuit having a first resonance frequency;

a conductive coupling element, operative as a series resonant circuit having the first resonance frequency, and located in proximity to the conductive ground plane so as to be coupled thereto by a first field chosen from at least one of a first electric field and a first magnetic field; and a conductive monopole, operative as a series resonant circuit having a second resonance frequency, and located in proximity to the conductive coupling element so as to be coupled thereto by a second field chosen from at least one of a second electric field and a second magnetic field.

Typically, a first electric coupling generated by the first electric field is greater than a first magnetic coupling generated by the first magnetic field, and a second electric coupling generated by the second electric field is greater than a second magnetic coupling generated by the second magnetic field.

In one embodiment the conductive monopole and the conductive ground plane are coupled by a third field chosen from at least one of a third electric field and a third magnetic field.

There is further provided, according to an embodiment of the present invention, a method for producing an antenna, including:

providing a planar dielectric substrate;

forming a conductive ground plane on the substrate, the conductive ground plane being operative as a parallel resonant circuit having a first resonance frequency;

locating a conductive coupling element, operative as a series resonant circuit having the first resonance frequency, in proximity to the conductive ground plane so as to be coupled thereto by a first field chosen from at least one of a first electric field and a first magnetic field; and locating a conductive monopole, operative as a series resonant circuit having a second resonance frequency, in proximity to the conductive coupling element so as to be coupled thereto by a second field chosen from at least one of a second electric field and a second magnetic field.

The present invention will be more fully understood from the following detailed description of the embodiments thereof, taken together with the drawings in which:

DETAILED DESCRIPTION OF EMBODIMENTS

Figure 1:
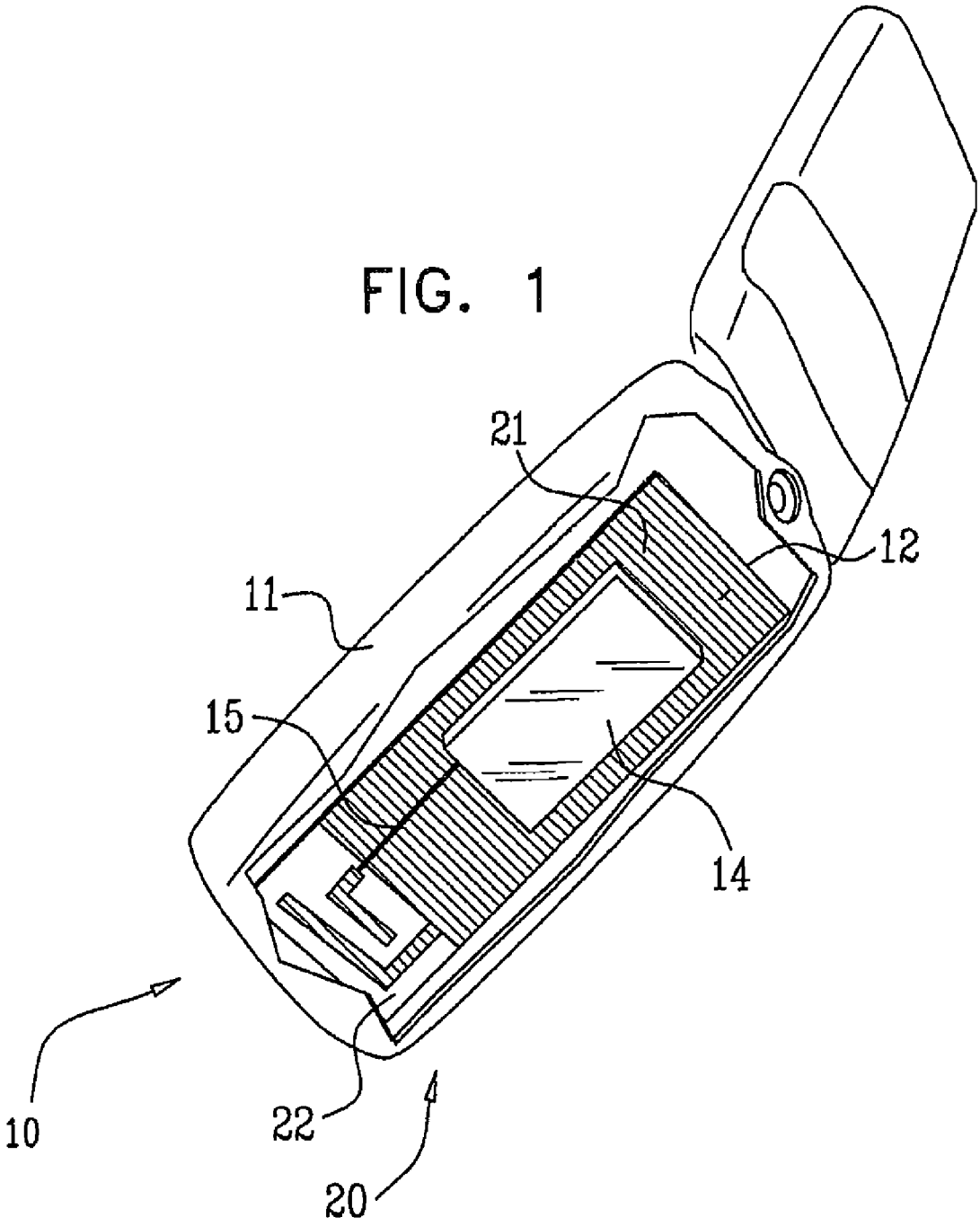
FIG. 1 is a schematic diagram of a communication device, according to an embodiment of the present invention.

Reference is now made to FIG. 1, which is a schematic diagram of a communication device 10, according to an embodiment of the present invention. Device 10 is typically a cellular phone or a personal digital assistant (PDA), and the device is hereinbelow assumed to comprise a cellular phone. Phone 10 has an enclosure 11, within which operational elements of the phone are mounted. Phone 10 comprises a transceiver 14 which is mounted on a dielectric substrate 22. Typically, substrate 22 is a planar dielectric substrate for a multilayer printed circuit board (PCB) 12, and components of transceiver 14 are mounted on the substrate. In some embodiments of the present invention, substrate 22 may comprise one or more dielectric layers of multilayer PCB 12, and other dielectric layers of the multi-layer PCB may be located above and/or below substrate 22. For clarity, such other layers are not shown in FIG. 1. It will be understood that substrate 22 may comprise dielectrics other than those used for a PCB. For example, the scope of the present invention includes substrates such as are formed from flexible dielectrics, and/or dielectrics that may be coated and/or deposited and/or painted onto a surface.

Substrate 22 is typically one layer of PCB 12, which comprises a conductive ground plane 21 as another layer. An antenna 20, herein by way of example assumed to comprise a multi-band antenna, is formed on substrate 22, and the antenna is coupled to transceiver 14 by a feed 15. Feed 15 may be any convenient system that efficiently transfers radiation between the transceiver and the antenna, and is herein by way of example assumed to comprise a coaxial cable. Antenna 20 is described in more detail below.

Figure 2A:
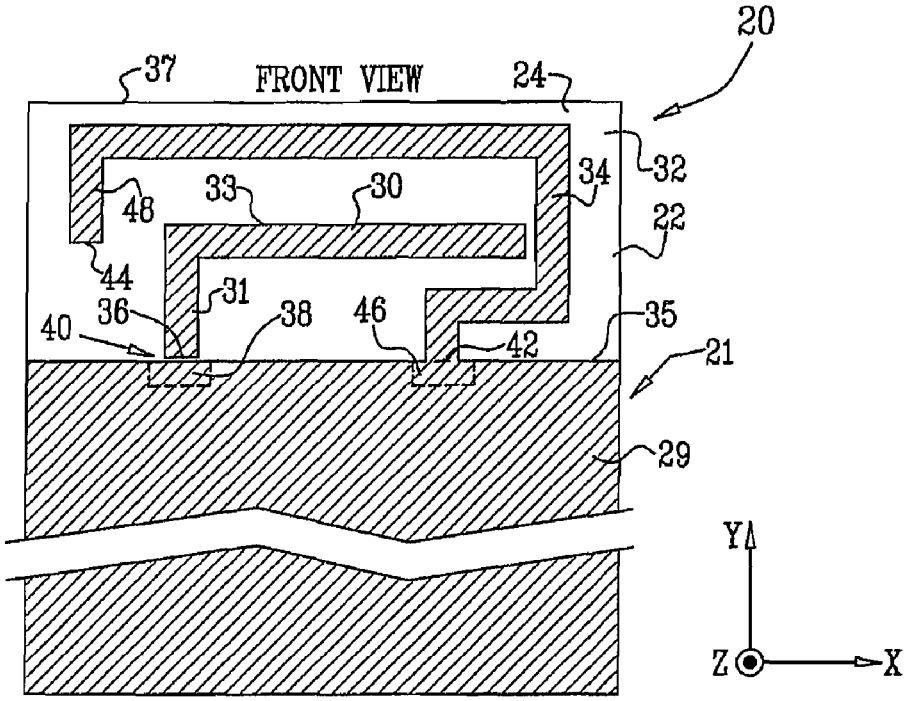
FIGS. 2A and 2B are schematic diagrams of a multi-band antenna.
Figure 2B:
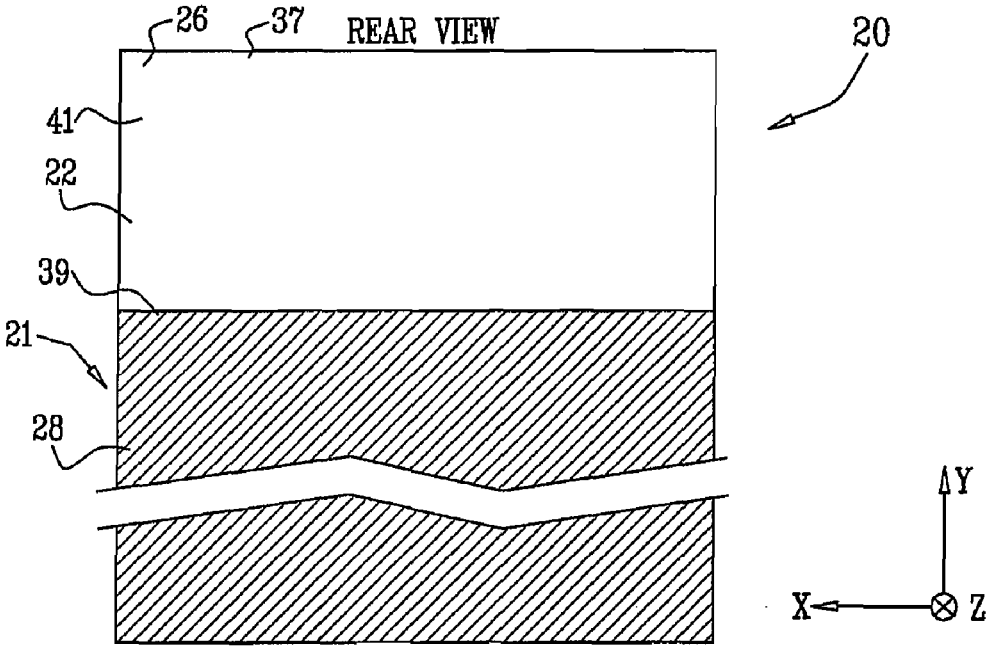

FIGS. 2A and 2B are schematic diagrams of multi-band antenna 20, according to an embodiment of the present invention. FIGS. 2A and 2B show two views of antenna 20 and substrate 22: a front view of a front surface 24 of the substrate, and a back view of a rear surface 26 of the substrate. The views are shown relative to a set of x, y, z orthogonal axes. Substrate 22 is assumed by way of example to be approximately rectangular with dimensions of the order of 115 mm long×40 mm wide. Also by way of example, the substrate is assumed to be approximately 1 mm in depth.

In the following description a section 28 of ground plane 21, having a ground plane edge 39 parallel to the x axis, is assumed to be formed to cover approximately the lower 100 mm of rear surface 26. A section 29 of the ground plane is galvanically connected to section 28, typically by vias not shown in FIGS. 2A and 2B. Section 29 has a ground plane edge 35 parallel to the x axis, and is assumed to cover approximately the lower 100 mm of front surface 24. Thus ground plane edges 35 and 39, respectively defining a top region 32 of the front surface of the substrate and a top region 41 of the rear surface, are approximately 15 mm from a top edge 37 of substrate 22. Except as described below, regions 32 and 41 do not have conductive material.

A conductive folded single-band monopole 30 is formed in top region 32, typically as a strip of conductive material having a constant width along the strip of approximately 1 mm. However, embodiments of the present invention may use different widths of conductive material, typically within a range of approximately 0.5 mm to approximately 4 mm. Furthermore, in some embodiments of the present invention, the width of the conductive material may be varied along the length of monopole 30. Monopole 30 is arranged to have two connected orthogonal linear sections 31 and 33, respectively parallel to the y and x axes, having a total length of approximately 3 cm. Typically, for example for cellular applications, the total length of monopole 30 is within a range between approximately 2.5 cm and approximately 4 cm, so that the ratio of monopole length to ground plane length is in a range between approximately 0.25 and 0.6. At these lengths, in a high-frequency radiation band between approximately 1.7 GHz and approximately 2.2 GHz and having a center frequency of approximately 1.9 GHz, the monopole acts as a single-band monopole which is an approximately quarter-wavelength radiator, thus radiating efficiently in the high-frequency band.

The monopole is arranged so that an end 36 is close to, but does not touch, edge 35, at a region 38 of the ground plane. Feed 15 (FIG. 1) has a "live" side and a ground side which are respectively connected to end 36 and region 38. Thus, if feed 15 comprises a coaxial cable, the central conductor of the cable is connected to end 36, and the shield of the cable is connected to region 38. Alternatively, other systems known in the art may be used to feed the antenna, such as a microstrip. Region 38 is herein termed the ground plane feed region, and is assumed to be a region bordering edge 35 and within a distance of the order of 5 mm from end 36. End 36 and region 38 act as a feed zone 40 for antenna 20.

A second element 34, herein also termed a coupling element, is also formed in top region 32. Element 34 is formed from a conductive strip which typically has the same width as the strip forming monopole 30. The coupling element is typically arranged to have a length that is approximately 1.5 times the length of monopole 30, or longer. Typically, the length of coupling element 34 is approximately twice or more the length of monopole 30.

Element 34 is configured in top region 32 to be folded around monopole 30 so as to at least partially enclose the monopole. The folding may be accomplished by arranging different linear sections of element 34 to be parallel to the x or y axes, as shown in the figure. In the case of monopole 30, element 34, and ground plane edge 35 lying on a common surface of substrate 22, the element is considered to be folded around the monopole if some section of the element may be chosen so that a portion of the monopole lies between the chosen section and ground plane edge 35, as measured in the surface and orthogonally to the edge.

Alternatively, monopole 30, element 34, and ground plane edge 35 may lie on two or more different surfaces of substrate 22, the surface wherein the monopole lies being termed the monopole surface. In this case, the element is considered to be folded around the monopole if some section of a projection of the element onto the monopole surface may be chosen so that a portion of the monopole lies between the chosen section and ground plane edge 35, or a projection of ground plane edge 35 onto the monopole surface, as measured in the monopole surface and orthogonally to the edge.

Regarding the term "projection," in the specification and in the claims, if an element is in a plane, a projection of the element onto the plane is assumed to be congruent with the element.

Element 34 has a first end 42 and a second end 44. End 42 is located so that typically it galvanically connects to edge 35 of ground plane 21 at a region 46, which has a different, separate, location from feed region 38. Region 46 is herein termed the ground plane coupling region, and is assumed to be a region of the ground plane bordering edge 35 and within of the order of 5 mm from end 42. Advantageously, element 34 and section 29 comprise one continuous piece of conductive material. The separation of coupling region 46 and feed region 38 is typically at least 5 mm, and both regions are typically located at least 3 mm from the ends of edge 35.

A terminating linear section 48 of element 34 is parallel to the y axis, and is arranged so that the distance between end 44 and edge 35 is in a range between approximately 1 mm and approximately 10 mm. In a disclosed embodiment, the distance is approximately 7 mm.

A low-frequency band is assumed herein to be in a range between approximately 820 MHz and approximately 960 MHz. The low-frequency band has a center frequency of approximately 880 MHz, which is approximately 55% less than the center frequency of the high-frequency band referred to above. In the low-frequency band monopole 30 couples electric fields via coupling element 34 to ground plane 21, which radiates efficiently in the low-frequency band, since it is of the order of half a wavelength in length for these frequencies. Coupling element 34 acts as a resonant coupling element which does not radiate. Element 34 differs from a parasitic element by virtue of the fact that resonance frequencies of the element and monopole 30 are in different ranges. Typically, the difference between the two resonance frequencies is greater than 33% of the center frequency of the high-frequency band. Thus antenna 20 acts as an efficient radiator in both the low-frequency and high-frequency bands. Inspection of FIG. 2A shows that, in addition, antenna 20 is extremely compact, occupying a surface area of the order of 5 $cm^2$ or less, with the depth of a single printed circuit board. The lengths of sections of monopole 30 and/or coupling element 34 may be adjusted easily so that antenna 20 radiates efficiently at multi-band frequencies, other than those listed above, typically of the order of 900 MHz and of the order of 2 GHz. It will be understood that the extremely compact characteristic of the antenna may be maintained given such adjustment. Advantageously, the adjustments in lengths may be initially verified using antenna simulation software which typically involves a Method of Moments analysis. For example Agilent Technologies, of Santa Clara, Calif., provide a software package GENESYS™ that may be used for simulating the antenna.

The inventors have found that in embodiments of the present invention, typically the size of the ground plane mainly determines the widest possible bandwidth of the combined structure comprising monopole, coupling element, and ground plane, and that the length of the coupling element in conjunction with the resonance frequency of the ground plane mainly determines the center frequency of the bandwidth. In the case of a communication device such as a cell phone, the size of the ground plane may be constrained by the dimensions of the cell phone. However, within these constraints, by adjusting the sizes of the coupling element and/or the ground plane, an antenna with a wide or a narrow bandwidth, and having an efficiency of approximately 30% or more, may be configured for a wide range of frequencies.

Figure 2C:
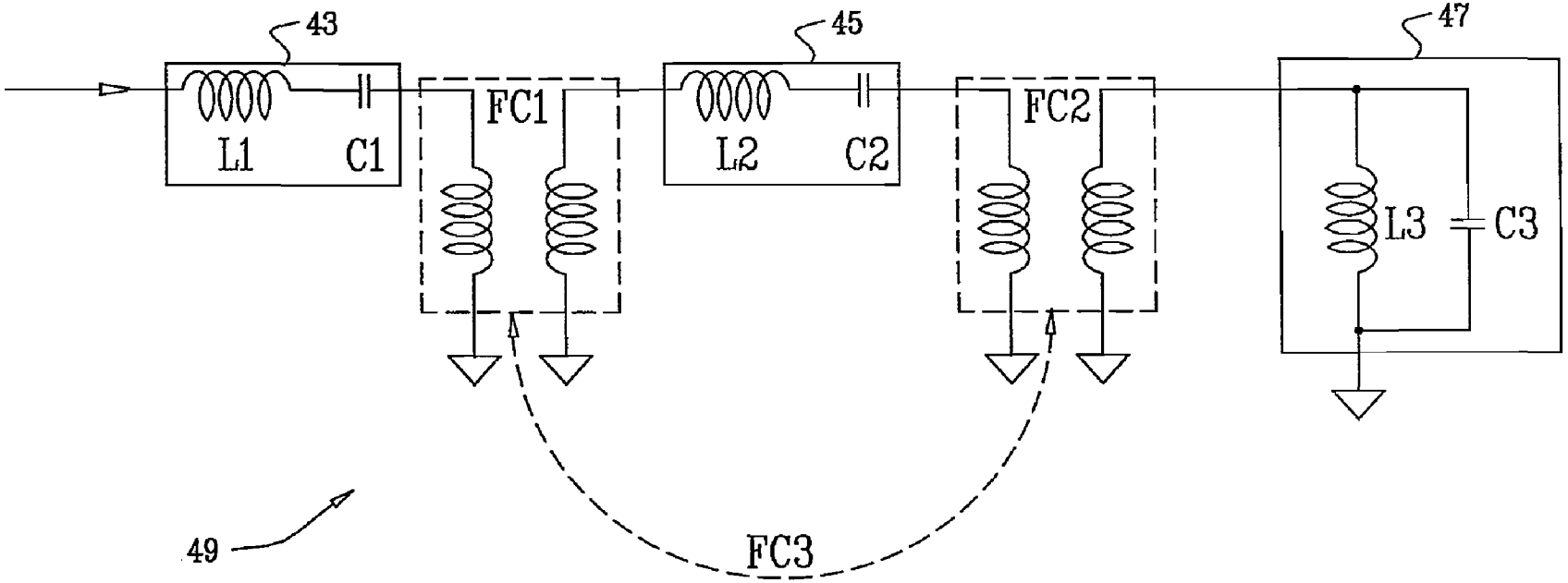
FIG. 2C is a schematic equivalent circuit of the antenna, according to an embodiment of the present invention.

FIG. 2C is a schematic equivalent circuit 49 of antenna 20, according to an embodiment of the present invention. Monopole 30 typically acts as a first series resonant circuit 43, comprising an inductor L1 and a capacitor C1. Coupling element 34 typically acts as a second series resonant circuit 45, comprising an inductor L2 and a capacitor C2. Ground plane 21 typically acts as a parallel resonant circuit 47, comprising an inductor L3 and a capacitor C3. Circuit 43 has a resonance frequency within the high-frequency band, and circuits 45 and 47 have approximately equal resonance frequencies within the low-frequency band.

Circuit 43 is shown as being coupled to circuit 45 by a field coupling FC1. Circuit 45 is shown as being coupled to circuit 47 by a field coupling FC2. Field couplings FC1 and FC2 are by electric or magnetic fields. Typically, because the couplings occur in proximity to the edge of ground plane 21, where the electric field is high, field couplings FC1 and FC2 substantially comprise only electric fields, and the couplings are mainly capacitive.

In addition to the two couplings described above, there may also be a field coupling FC3 between circuit 43 and circuit 47. This coupling, represented by a double headed arrow, is substantially similar to the couplings described above, i.e., the coupling may be by electric or magnetic fields, and is typically mainly by electric fields. The inventors are not aware of any good symbol to represent capacitive coupling, so it will be appreciated that the representations of field couplings FC1, FC2, and FC3 in FIG. 2C are purely illustrative. For the three couplings, the electric coupling of the electric field is greater than, and is typically significantly greater than, the magnetic coupling of the magnetic field.

The amount of coupling between the three different circuits is a function of the dimensions of monopole 30, coupling element 34, and ground plane 21, as well as of the relative positions of the monopole, the coupling element, and the ground plane with respect to each other. In addition, the amount of coupling is a function of the frequency at which the coupling occurs.

Equivalent circuits generally similar to equivalent circuit 49 apply, mutatis mutandis, to other embodiments of the present invention described herein. Changes to equivalent circuit 49 for such embodiments will be apparent to a person having ordinary skill in the art.

Figure 3A:
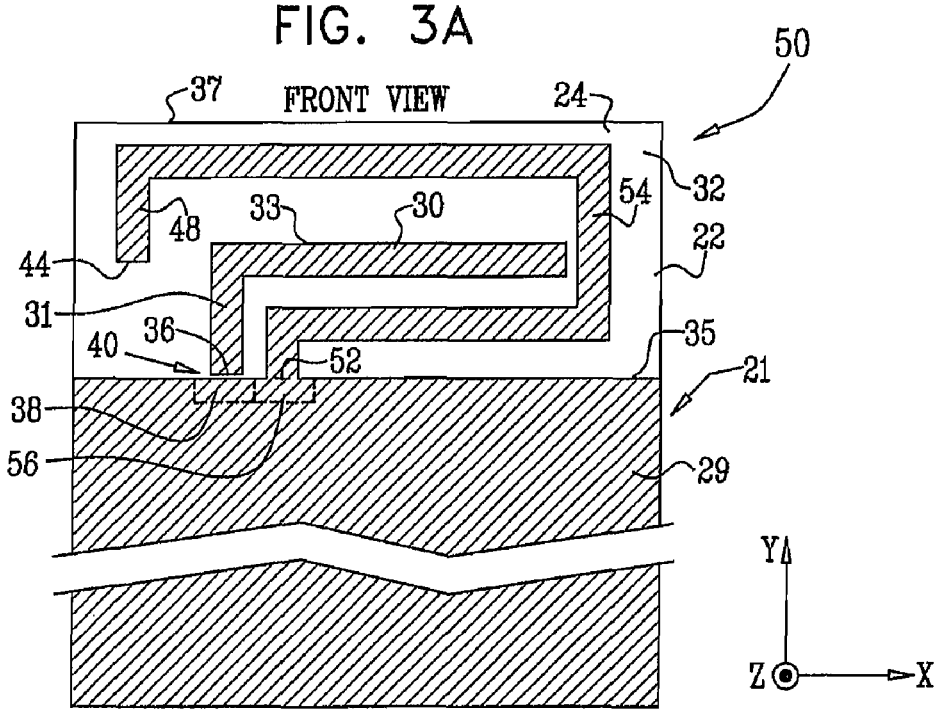
FIGS. 3A, 3B, and 3C are schematic diagrams of front views of multi-band antennas, according to embodiments of the present invention.

FIG. 3A is a schematic diagram of a multi-band antenna 50, according to an embodiment of the present invention. Apart from the differences described below, the operation of antenna 50 is generally similar to that of antenna 20 (FIGS. 2A and 2B), and elements indicated by the same reference numerals in both antennas are generally similar in construction and in operation. Antenna 50 has a rear view substantially similar to the rear view of antenna 20 (FIG. 2B).

Antenna 50 comprises a coupling element 54, which performs substantially the same functions as coupling element 34 (FIG. 2A). An end 52 of coupling element 54 connects to section 29 at a coupling region 56 of the ground plane. Coupling region 56 has generally the same dimensions as coupling region 46. In contrast to antenna 20, coupling region 56 is relatively close to feed region 38 and the two regions typically partially overlap. As for antenna 20, the coupling and feed regions for antenna 50 are both adjacent to a common edge 35.

Figure 3B:
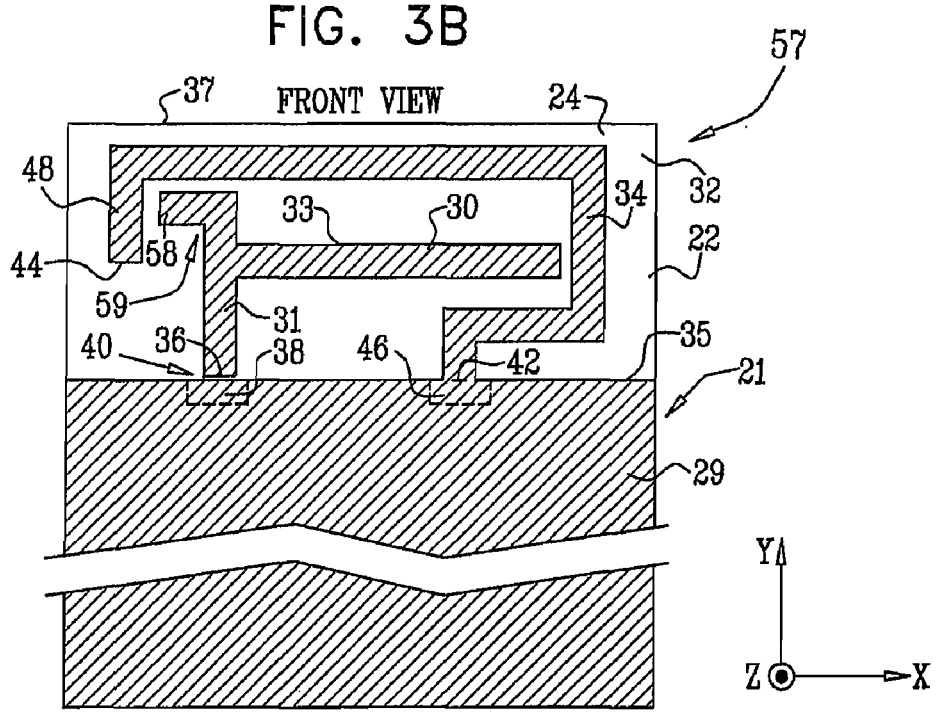

FIG. 3B is a schematic diagram of a multi-band antenna 57, according to an embodiment of the present invention. Apart from the differences described below, the operation of antenna 57 is generally similar to that of antenna 20 (FIGS. 2A and 2B), and elements indicated by the same reference numerals in both antennas are generally similar in construction and in operation. Antenna 57 has a rear view substantially similar to the rear view of antenna 20 (FIG. 2B).

In antenna 57 one or more further monopoles are galvanically connected to monopole 30 to form a multi-band monopole 59. By way of example, in antenna 57 a second monopole 58 is galvanically connected to monopole 30. The lengths of the monopoles in multi-band monopole 59 are typically set to be different, so that the multi-band monopole radiates in a plurality of frequency bands corresponding to the number of monopoles. The one or more further monopoles, such as monopole 58, typically have widths that are generally similar to the width of monopole 30.

Figure 3C:
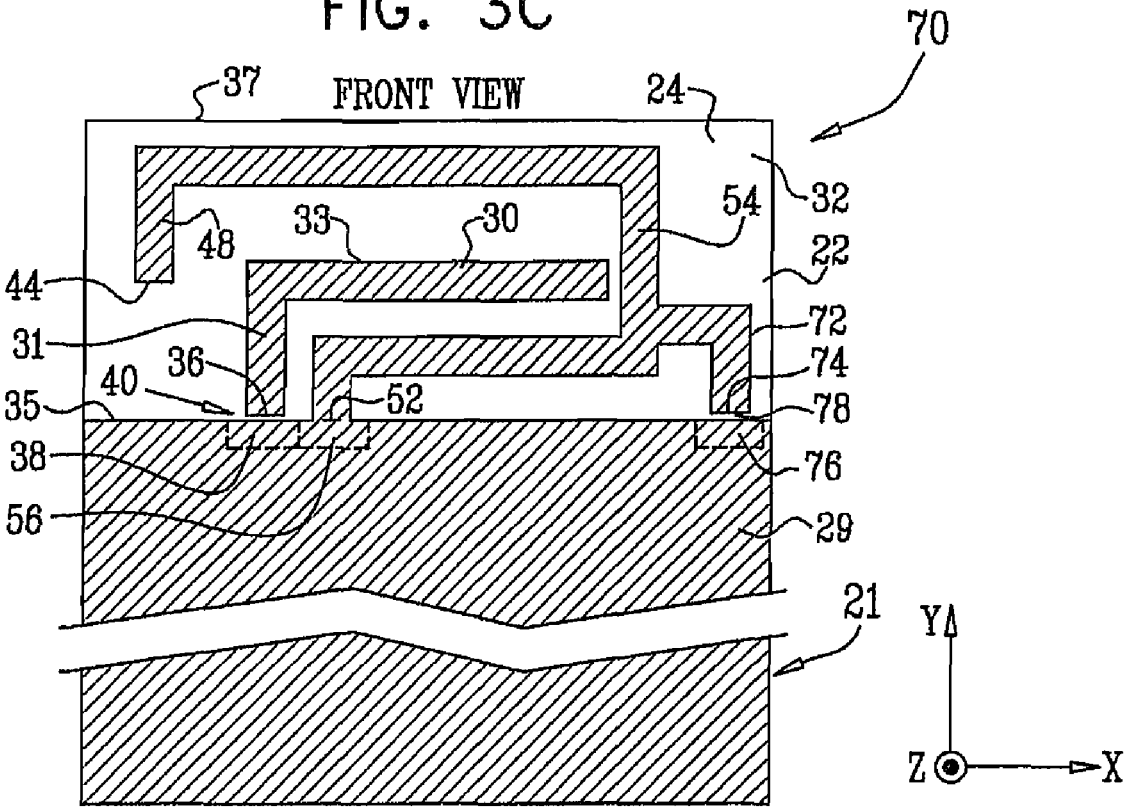

FIG. 3C is a schematic diagram of a multi-band antenna 70, according to an embodiment of the present invention. Apart from the differences described below, the operation of antenna 70 is generally similar to that of antenna 50 (FIG. 3A), and elements indicated by the same reference numerals in both antennas are generally similar in construction and in operation. Antenna 70 has a rear view substantially similar to the rear view of antenna 20 (FIG. 2B).

In antenna 70 a further coupling element 72 is galvanically connected to coupling element 54. Element 72 is in the form of an inverted "L" having a total length of the order of 1 cm. There is a gap 78 between an end 74 of element 72 and edge 35, the gap typically being of the order of 0.5 mm or less. Thus element 72 capacitively couples to a second coupling region 76 of ground plane 21. Region 76 comprises a region which borders edge 35 and is within of the order of 5 mm from end 74. The inventors have found that element 72 increases the coupling of monopole 30 to ground plane section 29, so that the ground plane radiates at the high-frequency band of the monopole, and so that the efficiency of radiation of antenna 70 improves. Dimensions of element 72, the x position of end 74, and the width of gap 78, may be altered to optimize the efficiency of radiation of the antenna.

Figure 4:
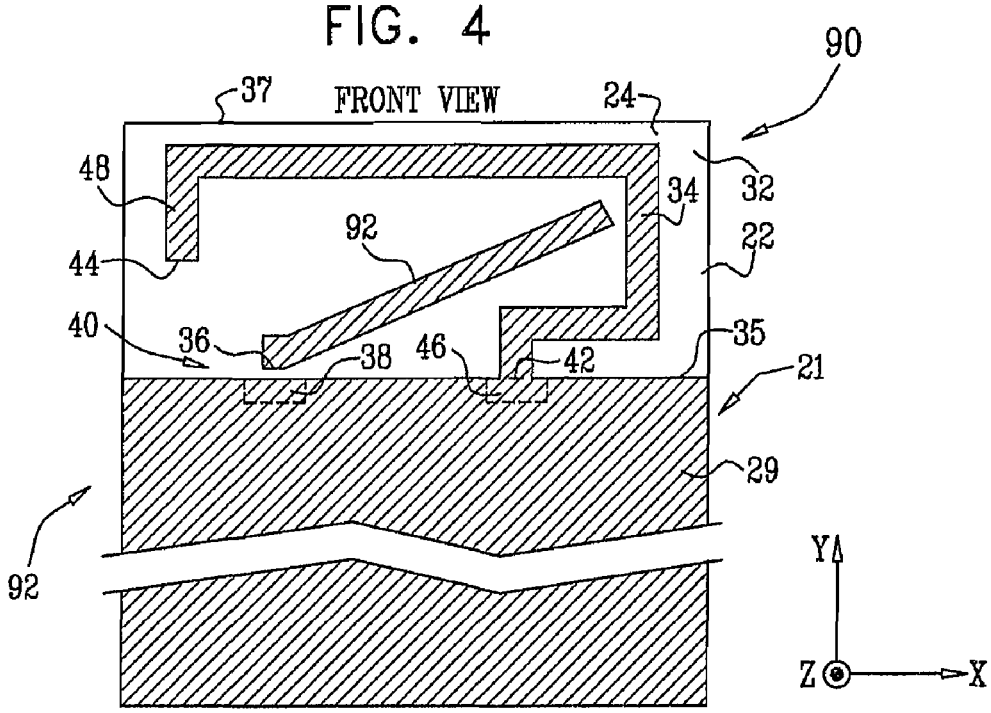
FIGS. 4 and 5 are schematic diagrams of front views of multi-band antennas, according to alternative embodiments of the present invention.
Figure 5:
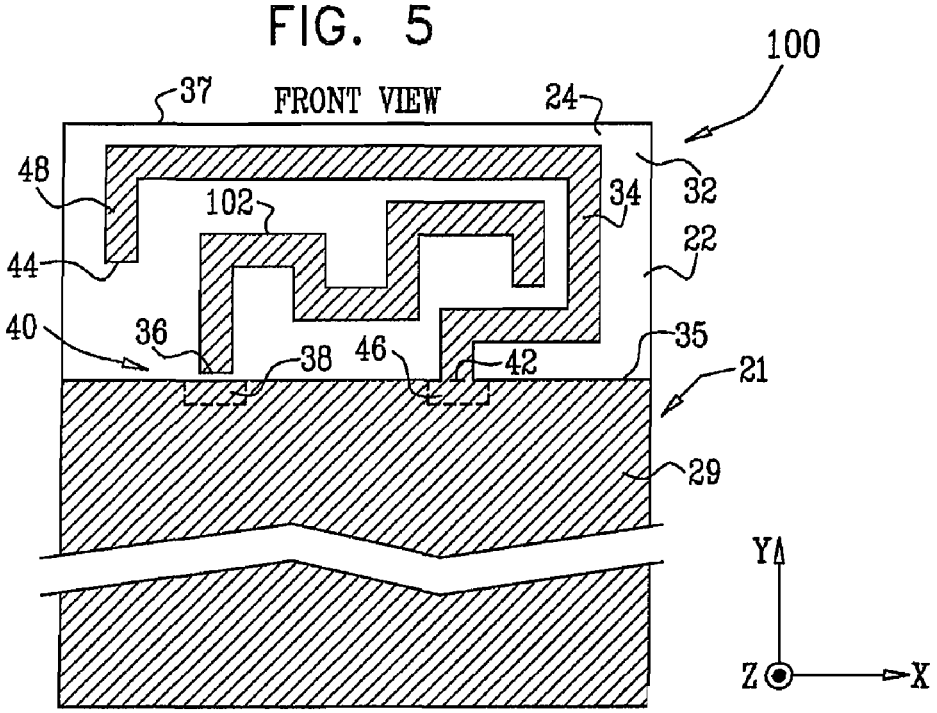

FIGS. 4 and 5 are schematic diagrams of front views of multi-band antennas 90 and 100, according to alternative embodiments of the present invention. Apart from the differences described below, the operation of antennas 90 and 100 is generally similar to that of antenna 20 (FIGS. 2A and 2B), and elements indicated by the same reference numerals in antennas 20, 90, and 100 are generally similar in construction and in operation. Antennas 90 and 100 have rear views substantially similar to the rear view of antenna 20.

In antenna 90, a substantially linear monopole 92, having approximately the same length as folded monopole 30, replaces the folded monopole. In antenna 100, a meander monopole 102, having approximately the same length as folded monopole 30, replaces the folded monopole. Linear monopole 92 and meander monopole 102 are typically formed as conductive strips approximately 1 mm wide, and function in substantially the same manner as monopole 30.

Figure 6:
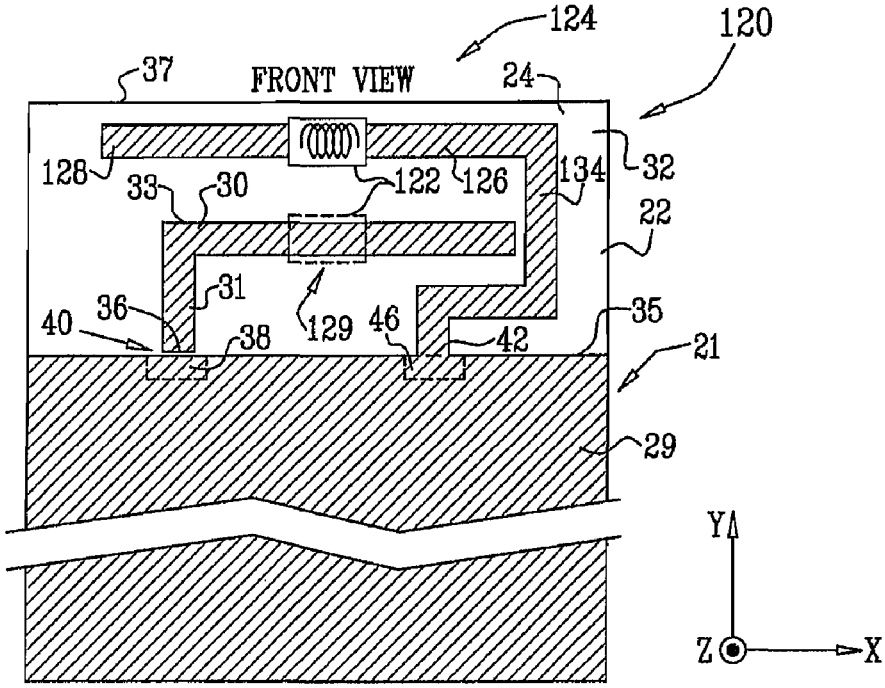
FIG. 6 is a schematic diagram of a multi-band antenna, according to a disclosed embodiment of the present invention.

FIG. 6 is a schematic diagram of a multi-band antenna 120, according to an embodiment of the present invention. FIG. 6 is a front view of antenna 120. Antenna 120 has a rear view substantially similar to the rear view of antenna 20. Apart from the differences described below, the operation of antenna 120 is generally similar to that of antenna 20 (FIGS. 2A and 2B), and elements indicated by the same reference numerals in both antennas are generally similar in construction and in operation. In antenna 120 one or more reactive devices 122 connect sections of a coupling element 134, which functions substantially as does element 34. In one embodiment, the one or more reactive devices comprise a capacitor and inductor in parallel, having values which cause the devices to act as a stop-band filter. In another embodiment, devices 122 comprise one inductive element 124 connecting a section 126 and a section 128 of coupling element 134.

Except for being broken into two sections, element 134 is generally similar in layout to coupling element 34. However, the presence of reactive devices 122 allows the physical lengths of sections 126 and/or 128 to be reduced so that the overall size of antenna 120 may be less than that of antenna 20. The change in physical length may be made substantially without affecting the overall performance of antenna 120. In the case of inductive element 124, a value may be chosen so that although the physical length of coupling element 134 is reduced, the presence of the inductive element allows the electrical length of the coupling element, i.e., the number of wavelengths at which the element resonates, to be substantially the same as the electrical length of coupling element 34. A typical value for the inductance of element 124 is of the order of 5 nH.

Alternatively or additionally, the one or more reactive devices 122 may be located on monopole 30, typically by breaking section 33 of the monopole at a location 129. For clarity, devices 122 on monopole 30 are shown in FIG. 6 with broken lines. Devices 122 located on the monopole perform generally the same functions, as described above, as devices 122 located on element 134.

Figure 7:
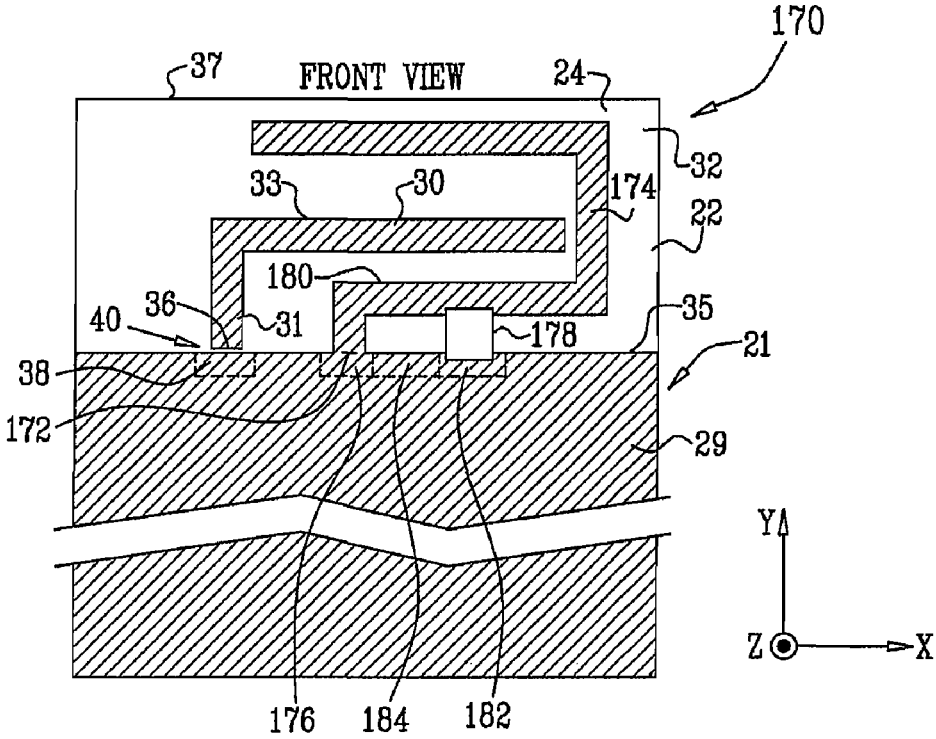
FIG. 7 is a schematic diagram of a multi-band antenna, according to another embodiment of the present invention.

FIG. 7 is a schematic diagram of a multi-band antenna 170, according to another embodiment of the present invention. FIG. 7 is a front view of antenna 170. Antenna 170 has a rear view substantially similar to the rear view of antenna 20. Apart from the differences described below, the operation of antenna 170 is generally similar to that of antenna 20 (FIGS. 2A and 2B), and elements indicated by the same reference numerals in both antennas are generally similar in construction and in operation. In place of coupling element 34, antenna 170 comprises a coupling element 174, which is generally similar to element 134 (FIG. 6), except that element 174 is configured as one continuous conductive strip. Coupling element 174 functions substantially as does element 34. An end 172 of element 174 is galvanically connected to ground plane 21 at a coupling region 176, which has generally the same dimensions as coupling region 46. In addition, one or more reactive devices 178 are connected between a region 182, in proximity to edge 35 of ground plane 21, and a portion 180 of element 174.

In one embodiment reactive devices 178 comprise a capacitor and inductor in series, or alternatively in parallel. Devices 178 may be positioned, i.e., locations of region 182 and/or the connection to portion 180, may be adjusted to effectively alter the position and/or size of coupling region 176, as shown by a broken line 184, as well as to alter the effective length of coupling element 174.

Figure 8A:
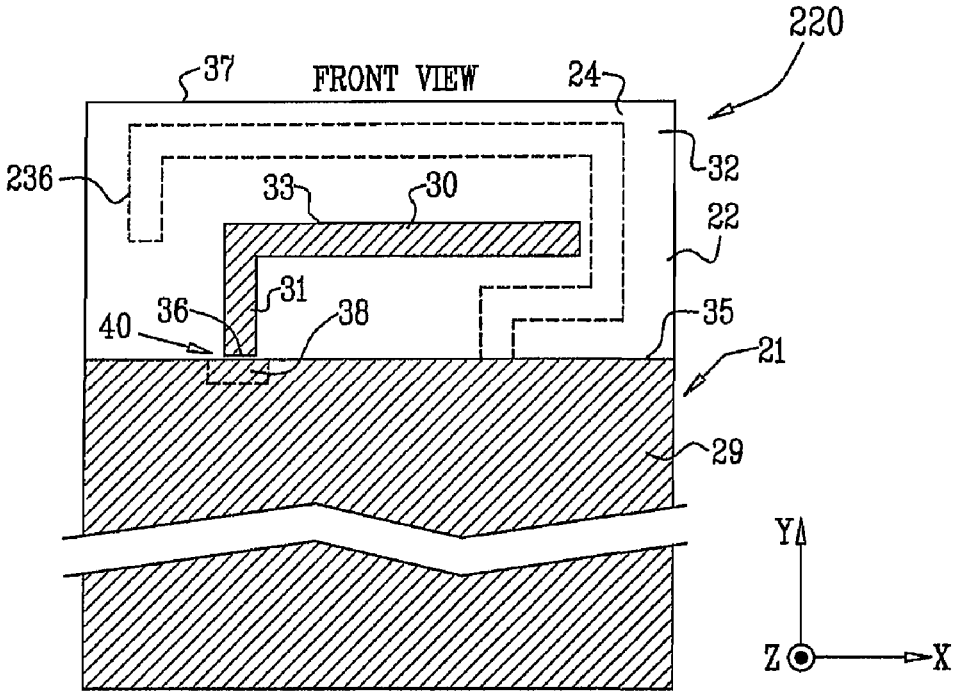
FIGS. 8A and 8B are schematic diagrams of views of a multi-band antenna, according to a further embodiment of the present invention.
Figure 8B:
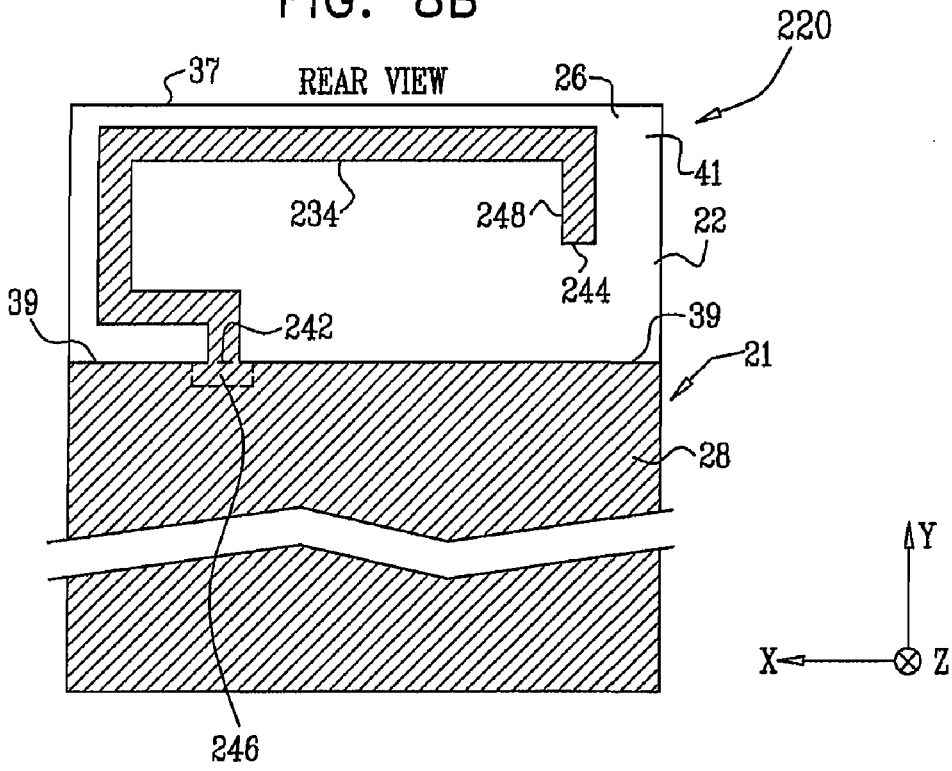

FIGS. 8A and 8B are schematic diagrams of a multi-band antenna 220, according to an embodiment of the present invention. FIG. 8A is a front view and FIG. 8B is a rear view of the antenna. Apart from the differences described below, the operation of antenna 220 is generally similar to that of antenna 20 (FIGS. 2A and 2B), and elements indicated by the same reference numerals in both antennas are generally similar in construction and in operation. In antenna 220, a coupling element 234 and folded monopole 30 are on opposite surfaces of substrate 22, so that element 234 is in region 41.

Elements 234 and 34 are generally similar in operation as well as in layout, so that, as shown by broken lines 236, element 234 folds around monopole 30. Elements 244, 248, and 242 of element 234 respectively correspond to elements 44, 48, and 42 of element 34. The overall length of element 234 is substantially similar to the overall length of element 34, and coupling element 234 connects to a coupling region 246 of section 28 of the ground plane, the coupling region having generally the same dimensions as coupling region 46. In contrast to antenna 20, the feed and the coupling regions of antenna 220 are adjacent to different edges, i.e., edges 35 and 39, of ground plane 21.

In configuring coupling element 234 on rear surface 26, the coupling element and section 28 of the ground plane are advantageously made from one continuous piece of conductive material.

Figure 9A:
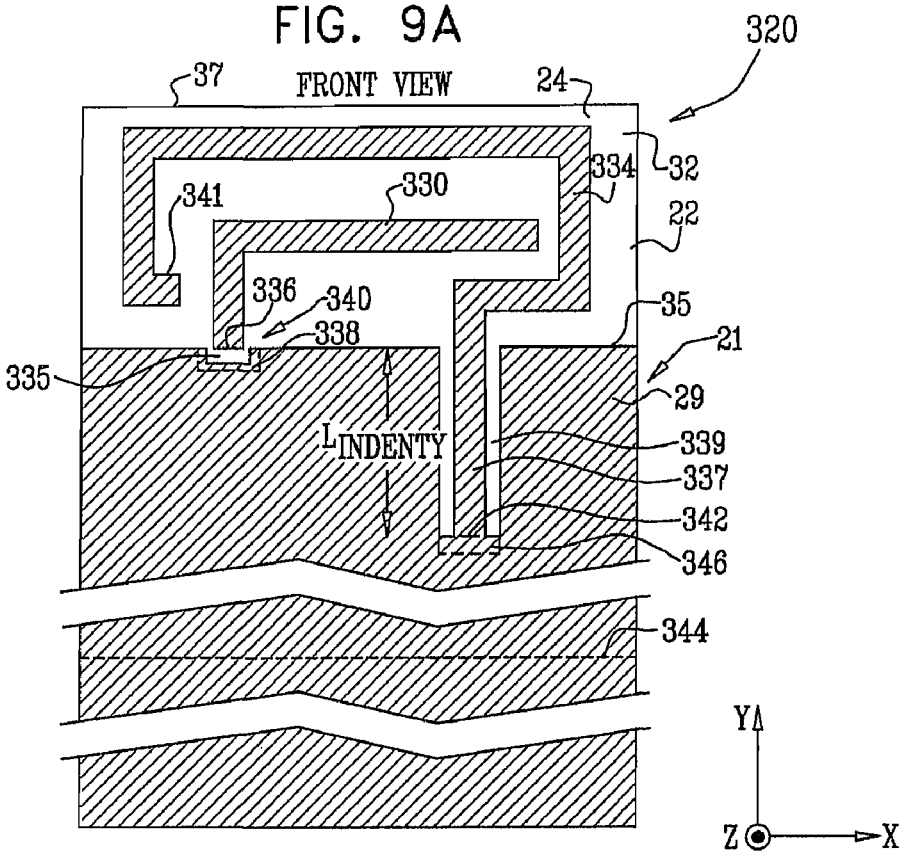
FIGS. 9A and 9B are schematic diagrams of multi-band antennas, according to alternative embodiments of the present invention.

FIG. 9A is a schematic diagram of a multi-band antenna 320, according to an embodiment of the present invention. FIG. 9A is a front view of antenna 320. Antenna 320 has a rear view substantially similar to the rear view of antenna 20. Apart from the differences described below, the operation of antenna 320 is generally similar to that of antenna 20 (FIGS. 2A and 2B), and elements indicated by the same reference numerals in both antennas are generally similar in construction and in operation. In antenna 320, a folded monopole 330 performs substantially the same functions as monopole 30. Monopole 330 is generally similar to monopole 30 in shape, dimensions, and location. However, an end 336 of monopole 330 is aligned with edge 35, and a first indentation 335 is made in edge 35 so that the alignment does not cause monopole 330 to galvanically contact section 29. A feed region 338, which has generally the same dimensions as feed region 38, is in proximity to the lower edge of indentation 335. Feed region 338 and end 336 act as a feed zone 340 for antenna 320.

A coupling element 334 is generally similar in function and in dimensions to element 34. However, a second indentation 339, which typically is linear and orthogonal to edge 35, is made in section 29, and element 334 comprises a section 337 which extends within indentation 339. Section 337 extends so that an end 342 of the section galvanically contacts to ground plane section 29, forming a coupling region 346 in proximity to the end. Coupling region 346 is a region within of the order of 5 mm from end 342. A length $L_{indent}$ of section 337, and of the indentation, may be set so as to take advantage of the different current and potential characteristics of section 29 as antenna 320 operates, so as to improve impedance matching of frequencies radiated by the antenna.

Thus, at edge 35 there is generally high potential but low current providing a high impedance, whereas at a central line 344 of section 29 there is generally high current but low potential providing a low impedance. Using these criteria, a value of $L_{indent}$ may be selected so as to optimize the voltage standing wave ratio (VSWR), i.e., to optimize the reflection coefficient and/or the radiation efficiency of antenna 320. Advantageously, the determination of an optimal value of $L_{indent}$ may be made using a Method of Moments software package, such as that referenced above. In one embodiment, a value of $L_{indent}$ is approximately 20 mm, for radiation in the high and low-frequency bands referred to above. In some embodiments, the value of $L_{indent}$ may be selected to set a polarization characteristic of antenna 320, typically the polarization in a high-frequency band of the antenna, since the polarization of radiation from the antenna is a function of the directions and magnitudes of currents flowing in ground plane section 29.

In contrast to element 34, a terminating linear section 341 of coupling element 334 is configured to be parallel to the x axis. In one embodiment, section 341 is approximately 5 mm long, and there is a gap of approximately 2 mm between the edge of section 341 and edge 35.

Figure 9B:
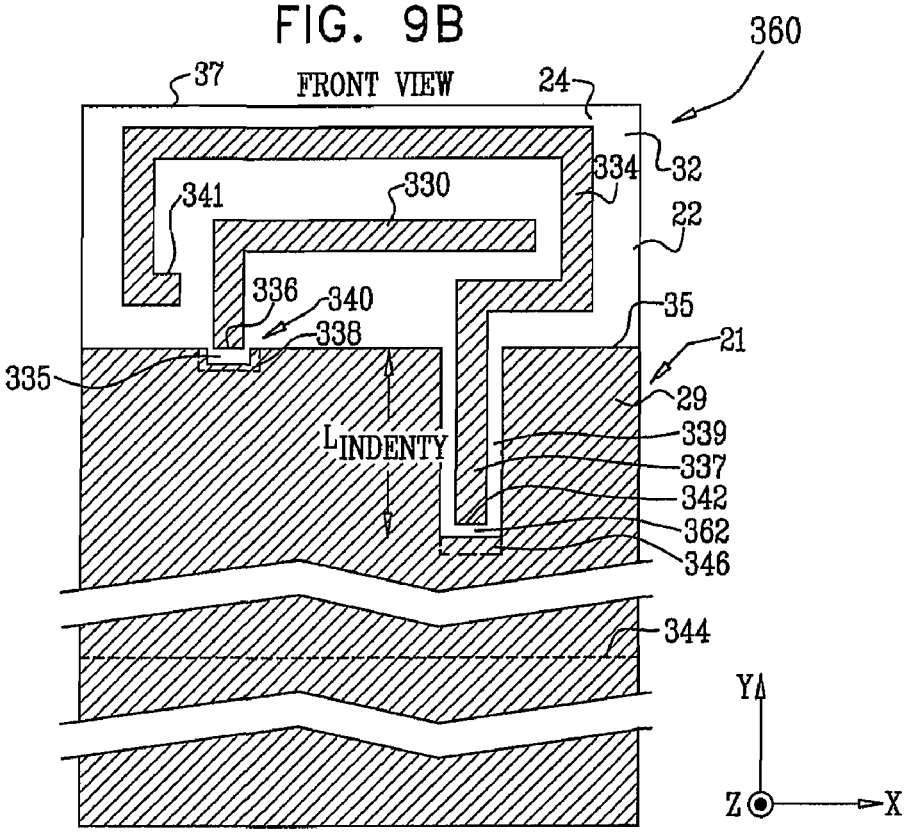

FIG. 9B is a schematic diagram of a multi-band antenna 360, according to an embodiment of the present invention. FIG. 9B is a front view of antenna 360. Antenna 360 has a rear view substantially similar to the rear view of antenna 20. Apart from the differences described below, the operation of antenna 360 is generally similar to that of antenna 320 (FIG. 9A), and elements indicated by the same reference numerals in both antennas are generally similar in construction and in operation.

In contrast to antenna 320, end 342 is not galvanically connected to ground plane section 29. Rather, there is a space 362 between end 342 and the ground plane, so that coupling element 334 only capacitively couples to the ground plane. By altering the dimensions of the space between indentation 339 and section 337, as well as of space 362, the directions of currents flowing in the ground plane adjacent to section 337, and the magnitudes of the currents, may be adjusted, so that the polarization of the radiation from antenna 360 may be correspondingly adjusted.

Figure 9C:
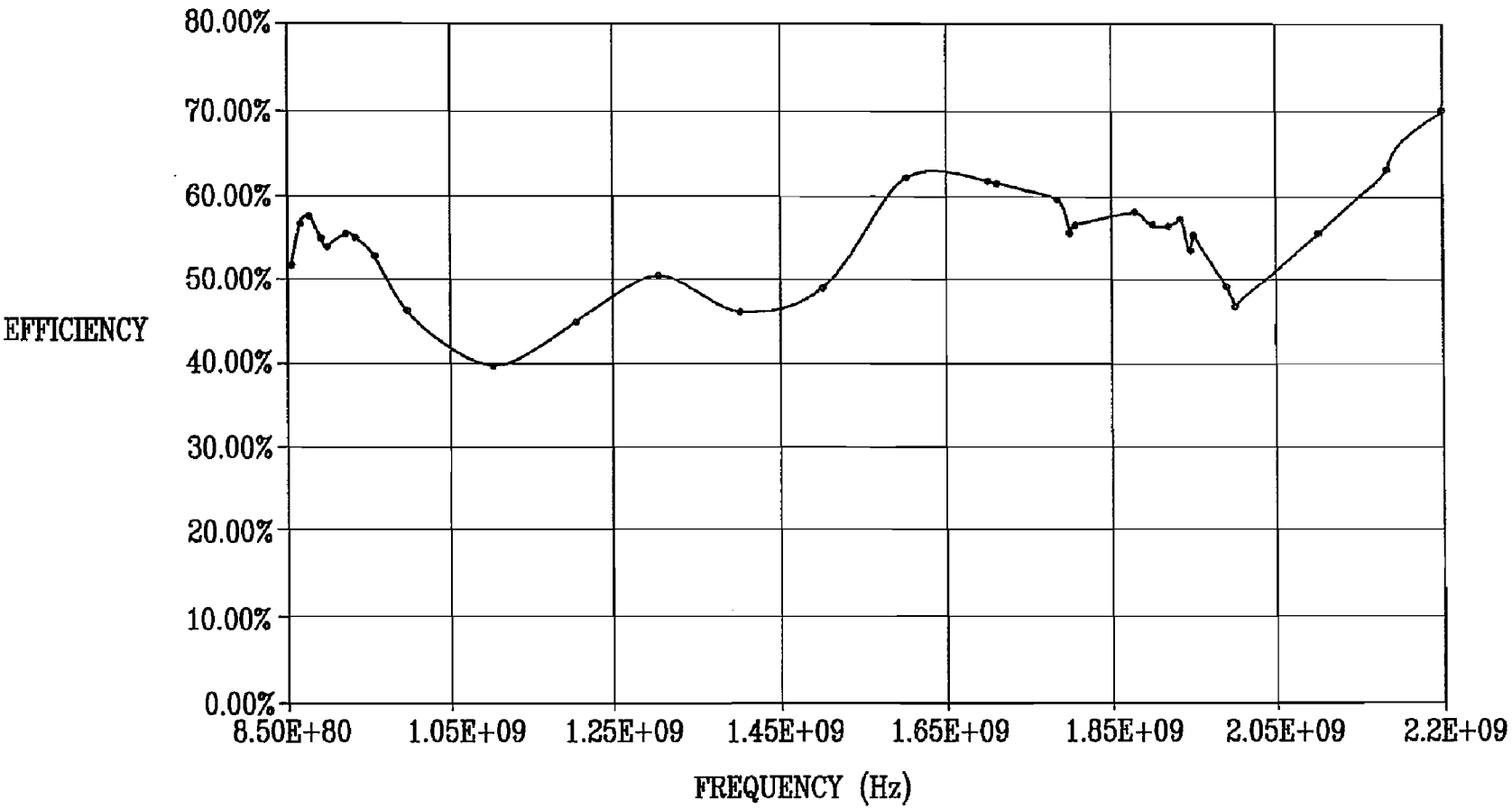
FIG. 9C is a schematic graph of antenna efficiency vs. frequency, according to an embodiment of the present invention.

FIG. 9C is a schematic graph of antenna efficiency vs. frequency, for an embodiment of the present invention. The graph shows values that the inventors have measured for a disclosed embodiment generally similar to that illustrated in FIG. 9A. As is shown in the graph, the efficiency for both the low-frequency band and the high-frequency band referred to above is typically 50% or better across both of the bands. For the whole frequency range from approximately 850 MHz to 2.2 GHz, which covers the five common cellular bands GSM850/900/1800/1900 and WCDMA2100, the efficiency is approximately 40% or greater, and is typically 50% or greater. Other embodiments of the present invention, described herein, have efficiency vs. frequency graphs which are generally similar to the graph of FIG. 9C.

As stated above, typically the size of the ground plane mainly determines the widest possible overall bandwidth of the combined structure of monopole, coupling element, and ground plane, and the length of the coupling element in conjunction with the resonance frequency of the ground plane mainly determines the center frequency. Thus, by adjusting the sizes of the coupling element and the ground plane, antennas having typical efficiencies of 30% or more for frequencies as low as approximately 400 MHz and as high as approximately 6 GHz may be formed, including the wireless local area network bands of 2.4 GHz and 5.6 GHz.

Figure 10A:
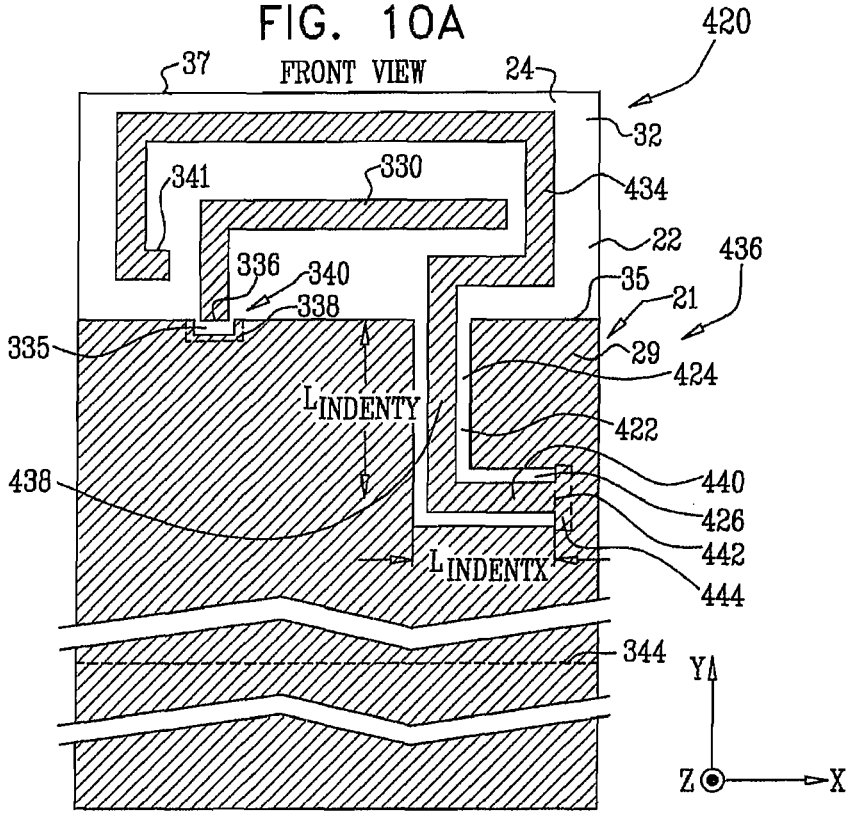
FIGS. 10A and 10B are schematic diagrams of multi-band antennas, according to other alternative embodiments of the present invention.

FIG. 10A is a schematic diagram of a multi-band antenna 420, according to an embodiment of the present invention. FIG. 10A is a front view of antenna 420. Antenna 420 has a rear view substantially similar to the rear view of antenna 20. Apart from the differences described below, the operation of antenna 420 is generally similar to that of antenna 320 (FIG. 9A), and elements indicated by the same reference numerals in both antennas 320 and 420 are generally similar in construction and in operation.

In antenna 420 an indentation 422 in section 29 is not linear, but, by way of example, is formed as an "L" shape, so that a first element 424 of the L is parallel to the y axis, and a second element 426 of the L is parallel to the x axis. A coupling element 434 is generally similar to coupling element 334. However, a terminating section 436 of element 434 is arranged to follow and lie within indentation 422, so that, in the example illustrated herein, section 436 is also L-shaped, having a first section 438 parallel to the y axis and a second section 440 parallel to the x axis. Section 440 terminates at an end 442 which galvanically connects to ground section 29. There is a coupling region 444 for end 442, which is a region within of the order of 5 mm from the end. The length of section 438 is $L_{indenty}$, and the length of section 440 is $L_{indentx}$.

Since indentation 422 and enclosed section 436 are non-linear, the electric fields between the different parts of the indentation and their respective enclosed sections are non-parallel. Thus, the electric field in element 424 due to section 438 is generally parallel to the x axis, whereas the electric field in element 426 due to section 440 is generally parallel to the y axis. The direction of the electric field between terminating section 436 and ground plane 29 affects the current flowing in the ground plane, which in turn affects the polarization of the radiation transmitted by antenna 420. Thus, by selecting different values of $L_{indenty}$ and $L_{indentx}$ for sections 438 and 440, the direction and/or the ellipticity of the polarization of radiation transmitted by antenna 420 may be adjusted. In one embodiment, the value of $L_{indenty}$ is approximately 15 mm, and the value of $L_{indentx}$ is approximately 10 mm, to give radiation in the high and low-frequency bands referred to above.

Alternatively or additionally, the direction and/or the ellipticity of the polarization of radiation transmitted by antenna 420 may be adjusted by altering other dimensions of indentation 422 and enclosed section 436. For example, a width $W_{indenty}$ of section 438, and/or a width $W_{indentx}$ of section 440 may be varied. Furthermore, the widths of the separations between section 438 and the edges of element 424, and the widths of the separations between section 440 and the edges of element 426 may also be varied. Altering dimensions of indentation 422 and enclosed section 436 alters the directions and magnitudes of currents flowing in the ground plane, which in turn alters the polarization of radiation. The dimensions may be adjusted so that, given the electric field restrictions that apply because of boundary conditions on the ground plane, the directions and magnitudes of currents flowing in the ground plane alter the polarization of radiation in a desired manner.

Figure 10B:
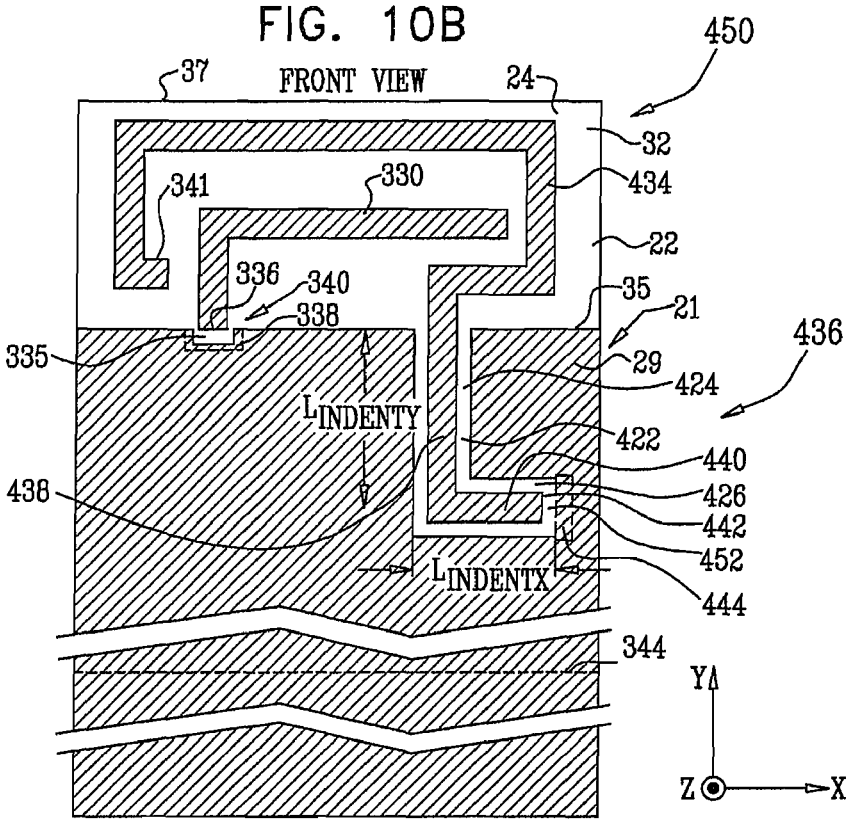

FIG. 10B is a schematic diagram of a multi-band antenna 450, according to an embodiment of the present invention. FIG. 10B is a front view of antenna 450. Antenna 450 has a rear view substantially similar to the rear view of antenna 20. Apart from the differences described below, the operation of antenna 450 is generally similar to that of antenna 420 (FIG. 10A), and elements indicated by the same reference numerals in both antennas are generally similar in construction and in operation.

In contrast to antenna 420, end 442 is not galvanically connected to ground plane section 29. Rather, there is a space 452 between end 442 and the ground plane, so that coupling element 434 only capacitively couples to the ground plane. By altering the dimensions of space 452 the directions of currents flowing in the ground plane adjacent to section 436, and the magnitudes of the currents, may be adjusted, so that the polarization of the radiation from antenna 450 may be correspondingly adjusted.

Figure 11:
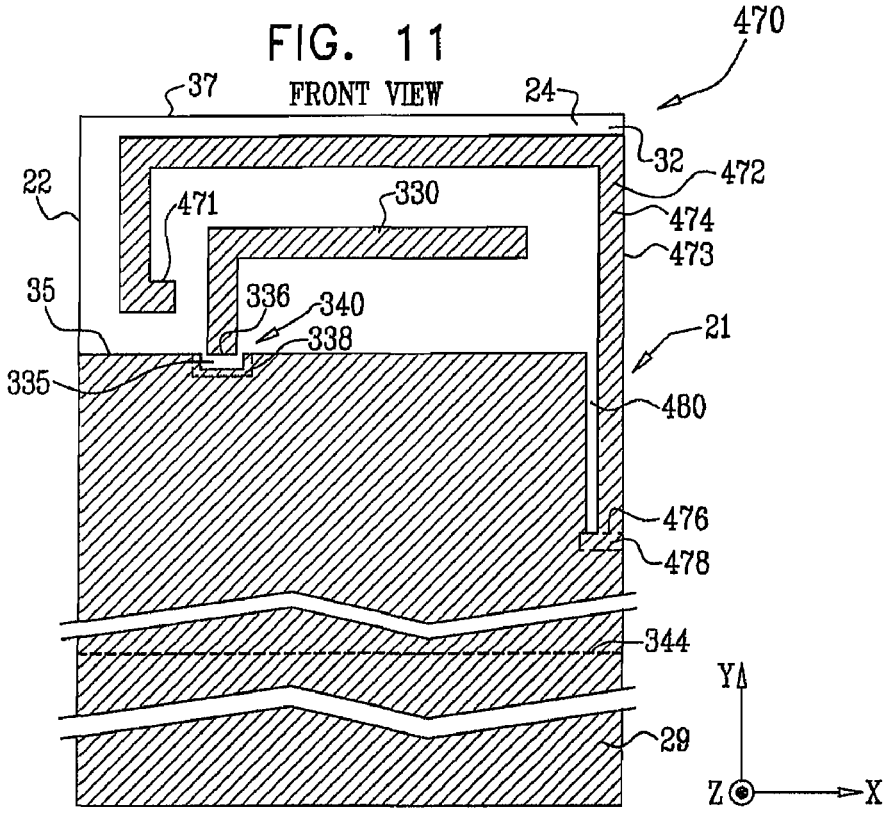
FIG. 11 is a schematic diagram of a multi-band antenna, according to a yet further disclosed embodiment of the present invention.

FIG. 11 is a schematic diagram of a multi-band antenna 470, according to another embodiment of the present invention. FIG. 11 is a front view of antenna 470. Antenna 470 has a rear view substantially similar to the rear view of antenna 20. Apart from the differences described below, the operation of antenna 470 is generally similar to that of antenna 320 (FIG. 9A), and elements indicated by the same reference numerals in both antennas 470 and 320 are generally similar in construction and in operation.

In place of coupling element 334, antenna 470 comprises a coupling element 472, which is generally similar to, and which performs substantially the same functions as, element 334. Coupling element 472 has a terminating section 471 similar to terminating linear section 341. However, in place of section 337, coupling element 472 comprises a linear section 474, which is located at an edge 473 of substrate 22, in an indentation 480 of section 29 of the ground plane. Thus, section 474 and section 29 have a common edge 473. Linear section 474 connects galvanically at an end 476 of the section to ground plane section 29, at a coupling region 478. Coupling region 478 is a region within of the order of 5 mm from end 476.

By adjusting the length of linear section 474, the impedance of coupling element 372 may be adjusted, substantially as described above for coupling element 334. In addition, as explained above, adjusting the dimensions of linear section 474 may allow for adjustment of the polarization of radiation radiated by antenna 470.

Figure 12:
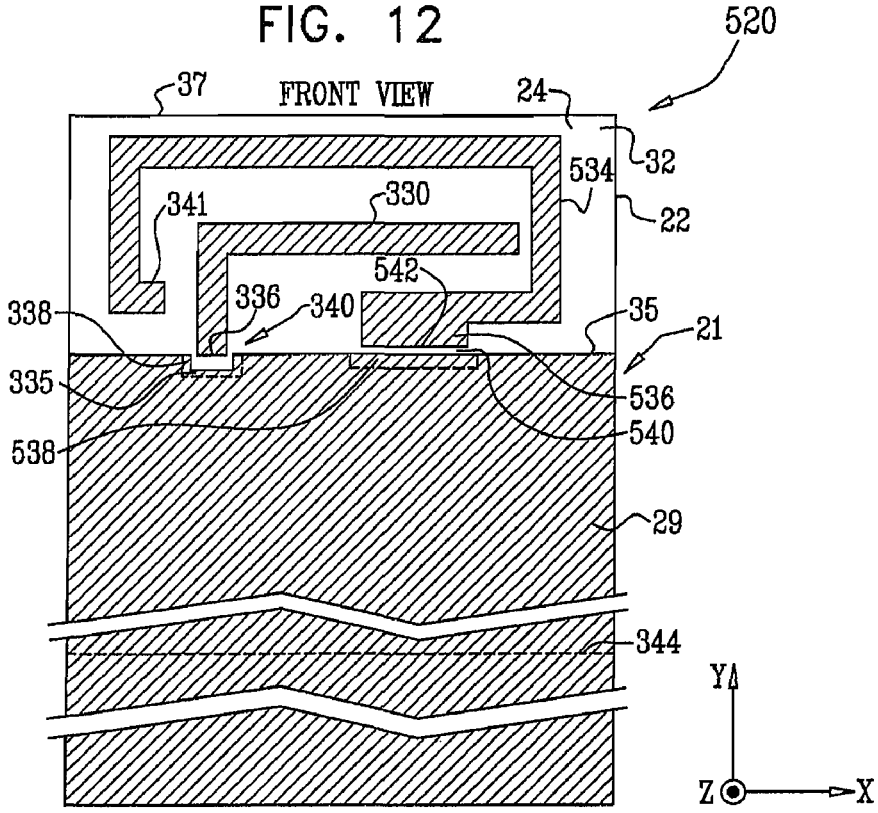
FIG. 12 is a schematic diagram of a multi-band antenna, according to a further alternative embodiment of the present invention.

FIG. 12 is a schematic diagram of a multi-band antenna 520, according to an embodiment of the present invention. FIG. 12 is a front view of antenna 520. Antenna 520 has a rear view substantially similar to the rear view of antenna 20. Apart from the differences described below, the operation of antenna 520 is generally similar to that of antenna 320 (FIG. 9A), and elements indicated by the same reference numerals in both antennas 520 and 320 are generally similar in construction and in operation. Antenna 520 comprises a coupling element 534, which has generally similar dimensions, and performs generally the same functions, as element 334. However, in contrast to element 334, coupling element 534 is not connected galvanically to ground plane section 29.

Rather, element 534 comprises a section 536 which parallels edge 35 and which capacitively couples element 534 to a coupling region 538 of section 29. Coupling region 538 is a region within of the order of 5 mm from a lower edge 542 of section 536. A gap 540 between section 536 and edge 35 is approximately 1 mm or less, and typically is approximately 0.5 mm. The length of section 536 and the size of gap 540 may be adjusted to change the capacitive coupling between element 534 and ground plane section 29. Typically, a width of section 536 is larger than that of other sections of element 534. In one embodiment, the length of section 536 is approximately 7 mm, and the width of the section is approximately 2 mm.

Figure 13:
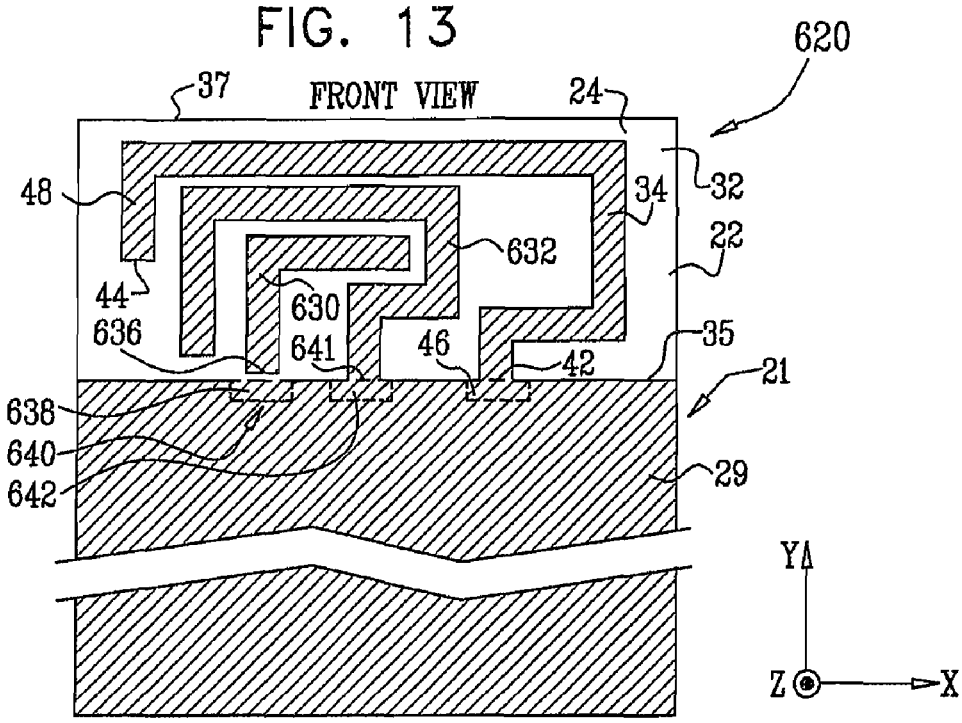
FIG. 13 is a schematic diagram of a multi-band antenna, according to another embodiment of the present invention.

FIG. 13 is a schematic diagram of a multi-band antenna 620, according to an embodiment of the present invention. FIG. 13 is a front view of antenna 620. Antenna 620 has a rear view substantially similar to the rear view of antenna 20. Apart from the differences described below, the operation of antenna 620 is generally similar to that of antenna 20 (FIGS. 2A and 2B), and elements indicated by the same reference numerals in both antennas 20 and 620 are generally similar in construction and in operation. Antenna 620 comprises coupling element 34 and coupling region 46 in section 29. In addition, antenna 620 comprises one or more further coupling elements formed on substrate 22 and connected galvanically or coupled capacitively to ground plane 21.

By way of example, antenna 620 is shown to comprise a second coupling element 632 having an end 641 connected galvanically to a second coupling region 642. Second coupling region 642 is a region within of the order of 5 mm from end 641. Antenna 620 also comprises a folded monopole 630. However, in contrast to antenna 20, monopole 630 is configured to be shorter in length than monopole 30, so that instead of acting generally as a radiating element, monopole 630 acts to couple high-frequency and low-frequency band electric or magnetic fields via elements 632 and 34, respectively, to ground plane 21.

Monopole 630 is fed at a feed zone 640 which comprises a feed region 638 in section 29 and an end 636 of the monopole. Feed region 638 has generally the same dimensions as feed region 38.

Second coupling element 632 is configured to radiate in the high-frequency band, so is approximately 3 cm in total length. Regions 46, 638, and 642 are separate regions, and coupling elements 34 and 632 are folded around monopole 630.

Figure 14:
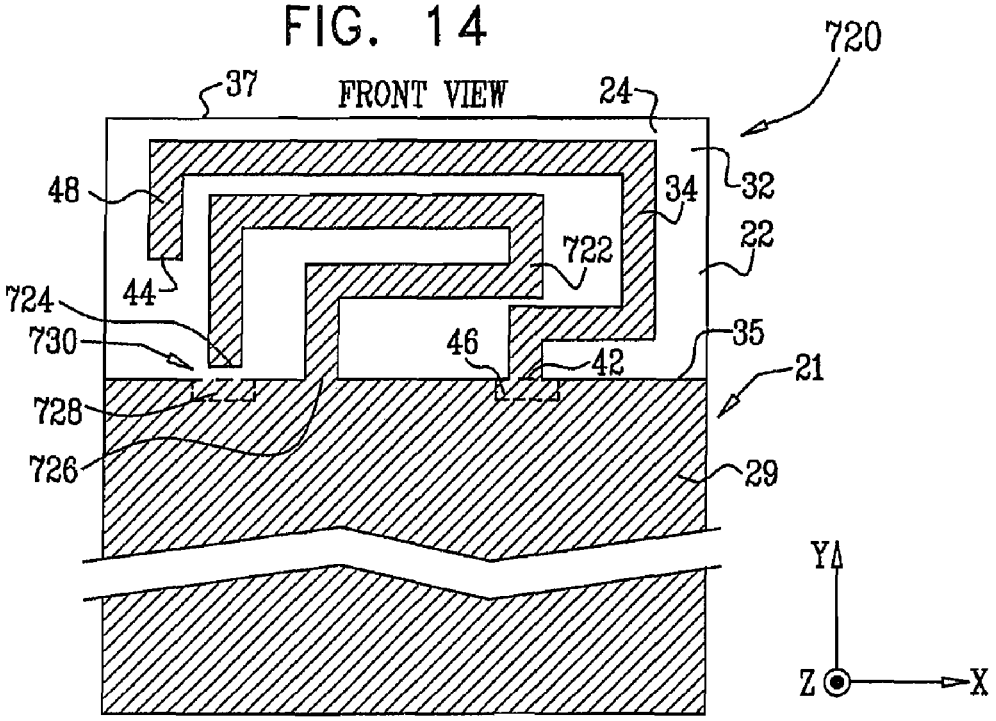
FIG. 14 is a schematic diagram of a multi-band antenna, according to yet another embodiment of the present invention.

FIG. 14 is a schematic diagram of a multi-band antenna 720, according to an embodiment of the present invention. FIG. 14 is a front view of antenna 720. Antenna 720 has a rear view substantially similar to the rear view of antenna 20. Apart from the differences described below, the operation of antenna 720 is generally similar to that of antenna 20 (FIGS. 2A and 2B), and elements indicated by the same reference numerals in both antennas 20 and 720 are generally similar in construction and in operation.

In place of monopole 30, antenna 720 comprises a loop 722, configured from a conductive strip generally as described above for monopole 30. Loop 722 has a length of approximately 3 cm for the cellular bands referenced above, and performs substantially the same functions as monopole 30, although the loop is not a member of the monopole family. Loop 722 has a ground plane feed region 728 which is in proximity to a first end 724 of the loop. Region 728 is a region within of the order of 5 mm from end 724. First end 724 and region 728 act as a feed zone 730 for antenna 720. End 724, region 728, and zone 730 are respectively similar in construction and operation to end 36, region 38 and feed zone 40 of antenna 20. Loop 722 has a second end 726 which galvanically connects to ground plane section 29.

Figure 15A:
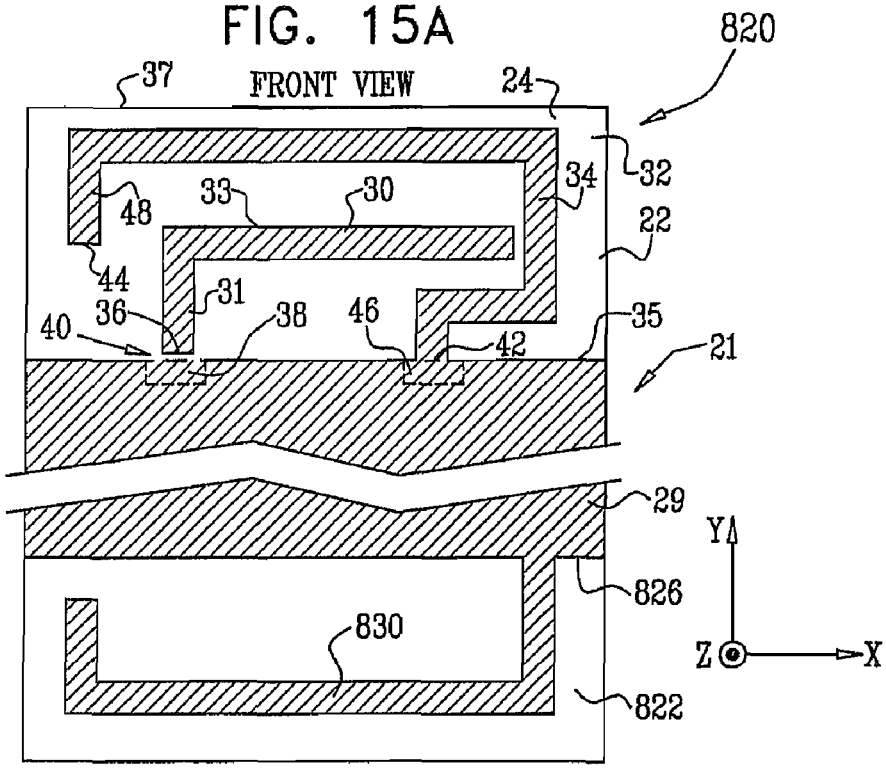
FIGS. 15A and 15B are schematic diagrams of views of a multi-band antenna, according to an embodiment of the present invention.
Figure 15B:
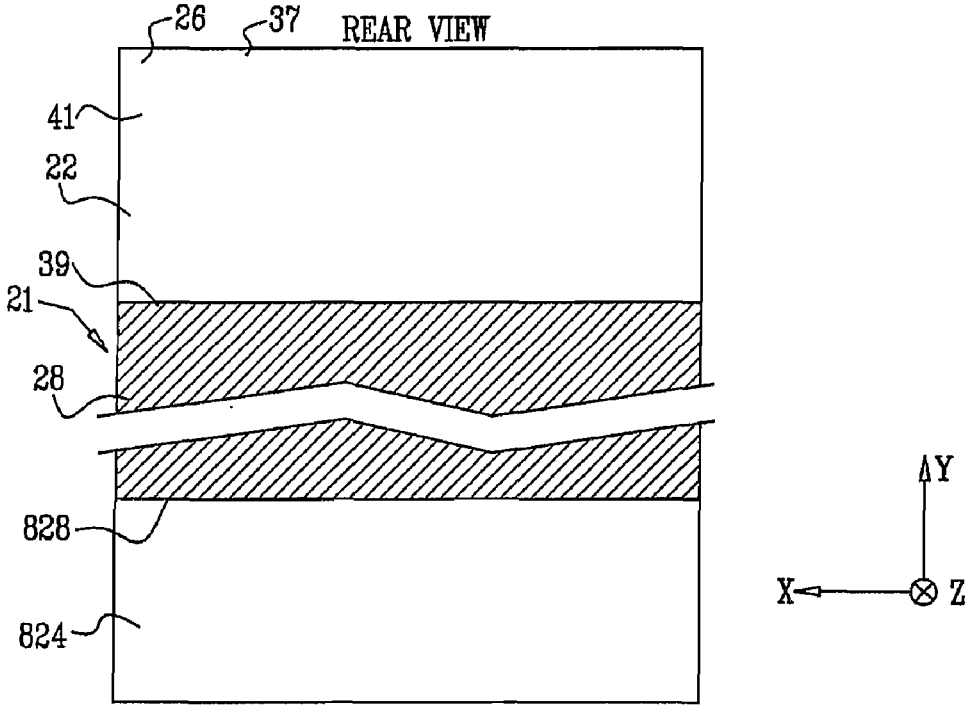

FIGS. 15A and 15B are schematic diagrams of a multi-band antenna 820, according to an embodiment of the present invention. FIG. 15A is a front view and FIG. 15B is a rear view of antenna 820. Apart from the differences described below, the operation of antenna 820 is generally similar to that of antenna 20 (FIGS. 2A and 2B), and elements indicated by the same reference numerals in both antennas 20 and 820 are generally similar in construction and in operation.

A region 822 of section 29, and a corresponding region 824 of section 28, are removed from those sections, forming lower edges 826 and 828 of the shortened sections. Regions 822 and 824 are substantially equal in length, the length typically being of the order of 10 mm. An element 830 is formed in region 822, element 830 being galvanically connected to section 29 at edge 826. Element 830 is configured to improve the specific absorption ratio (SAR) of antenna 820. If necessary dimensions of monopole 30 and coupling element 34 may be adjusted from those of antenna 20, so that element 830 does not significantly affect the efficiency of antenna 820 compared with the efficiency of antenna 20. Such adjustments may advantageously be made using antenna simulation software, such as that exemplified above.

Figure 16A:
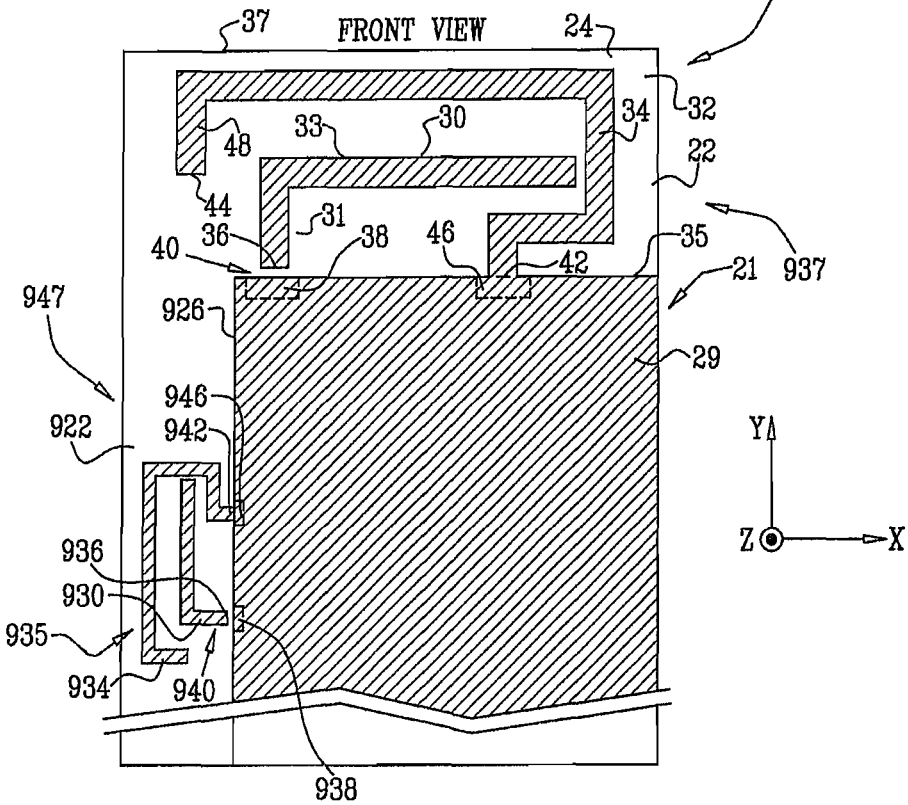
FIGS. 16A and 16B are schematic diagrams of views of a multi-band antenna, according to another embodiment of the present invention.
Figure 16B:
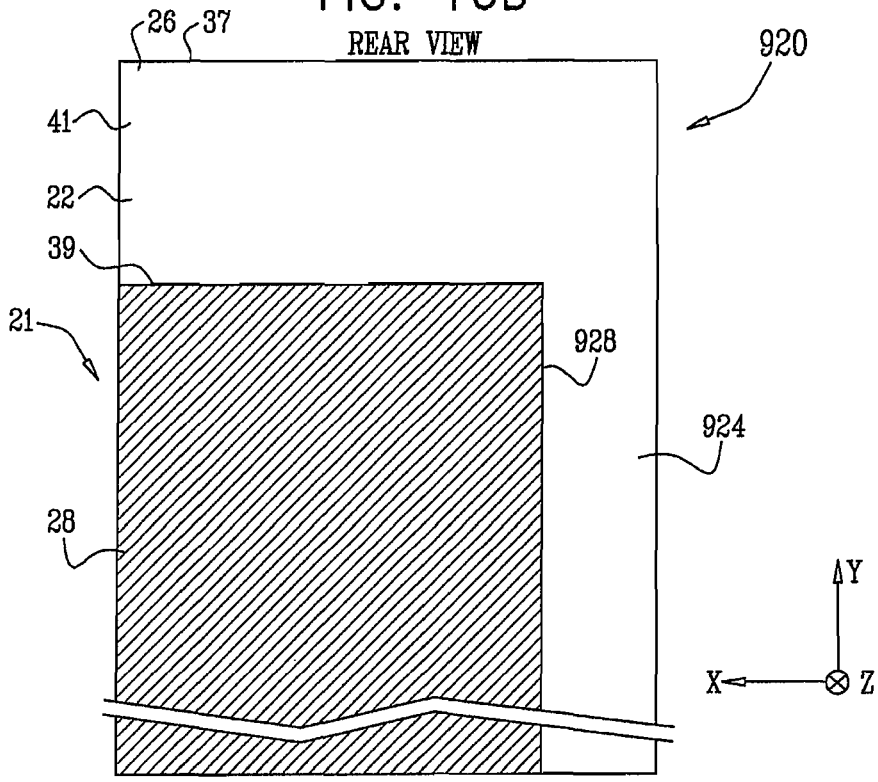

FIG. 16A and FIG. 16B are schematic diagrams of a multi-band antenna 920, according to an embodiment of the present invention. FIG. 16A is a front view and FIG. 16B is a rear view of antenna 920. Apart from the differences described below, the operation of antenna 920 is generally similar to that of antenna 20 (FIGS. 2A and 2B), and elements indicated by the same reference numerals in both antennas 20 and 920 are generally similar in construction and in operation.

In contrast to ground plane 21 of antenna 20, which extends across the width of substrate 22, in antenna 920 a rectangular area 922 of section 29, and a corresponding area 924 of section 28, are removed from the sections. Removal of areas 922 and 924 leaves respective edges 926 and 928 that are parallel to the y-axis. The width of the two areas is equal, typically having a value of approximately 7 mm.

A second folded monopole 930 and a second coupling element 934 are formed in area 922. A combination 935 of monopole 930 and coupling element 934 is typically geometrically similar to a combination 937 of monopole 30 and coupling element 34. However, combination 935 is typically reduced by a factor greater than 1 compared with the size of combination 937. Herein, by way of example, combination 935 is assumed to be reduced by a factor of 2. Combination 935 is rotated by 90° with respect to combination 937.

As for monopole 30, an end 936 of monopole 930 is close to, but does not touch, edge 926 at a second ground plane feed region 938, the region and the end forming a feed zone 940. Region 938 is assumed to be a region bordering edge 926 and within a distance of the order of 3 mm from end 936.

An end 942 of element 934 is galvanically connected to edge 926 of ground plane section 29 at a second ground plane coupling region 946. Region 946 is assumed to be a region within a distance of the order of 3 mm from end 942.

Combination 935 forms, together with ground plane 21, an antenna 947 which operates in two frequency bands, according to substantially similar principles as those described above for antenna 20. However, in contrast to antenna 20 wherein the low-frequency band is approximately determined by the length of ground plane 21, the low-frequency band of antenna 947, herein also termed the second low-frequency band, is approximately determined by the width of ground plane 21. The high-frequency band of antenna 947, herein also termed the second high-frequency band, is approximately determined by the length of monopole 930. Thus antenna 920 may operate in four different frequency bands.

In some embodiments of the present invention transceiver 14 (FIG. 1) comprises a single transceiver and feed 15 is a single feed which is coupled to monopole 30 and to monopole 930 at zones 40 and 940, so that the single transceiver operates in four frequency bands.

Alternatively, transceiver 14 comprises two sub-transceivers, and feed 15 comprises a respective feed to each sub-transceiver. One of the sub-transceivers is connected to monopole 30 at zone 40, and the second sub-transceiver is connected to monopole 930 at zone 940. The second low-frequency band of combination 935 may be configured to be approximately the same as the high-frequency band of combination 937. In this configuration, the different physical locations and/or orientations of combination 937 and 935 enable the two sub-transceivers to be operated in a diversity mode, wherein one of the sub-transceivers is configured as a main transceiver, and the second sub-transceiver is configured as a diversity transceiver. Operation in a diversity mode improves the overall quality of signals received by phone 10.

The scope of the present invention includes elements of antennas which are linear and/or curved, as is exemplified by an antenna 1020, described with reference to FIG. 17 below.

Figure 17:
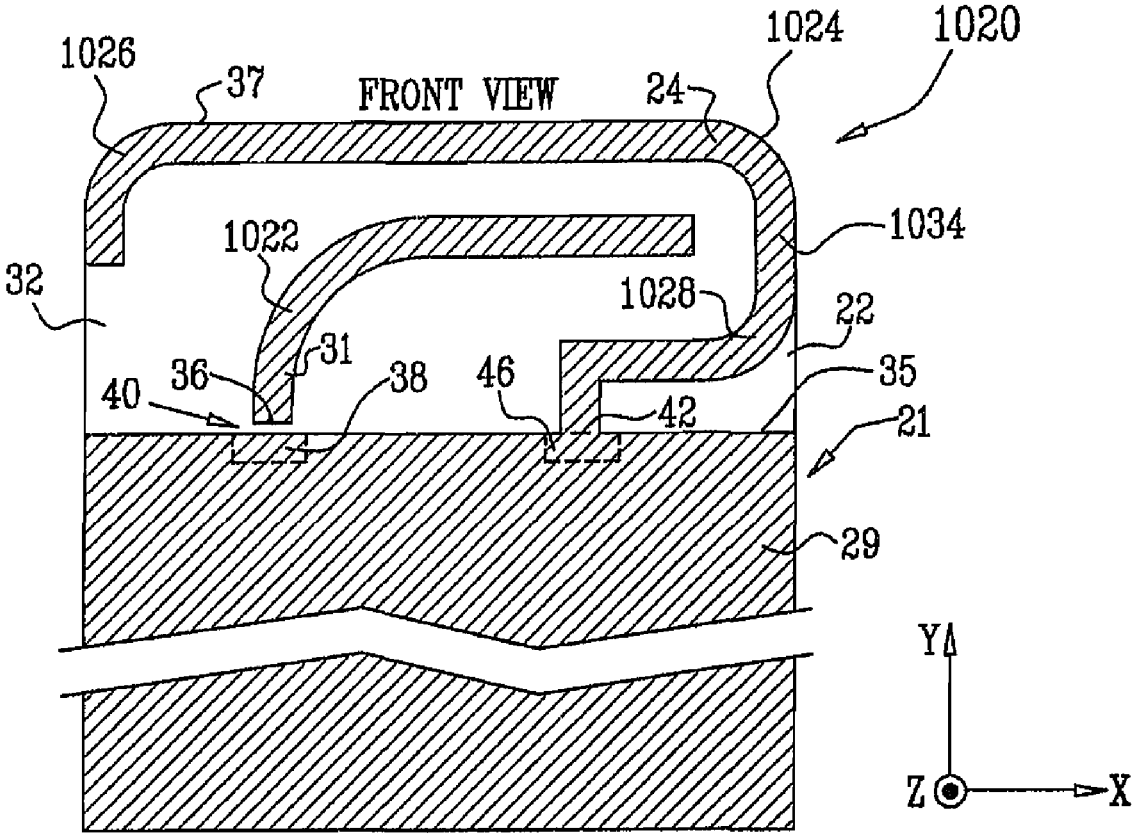
FIG. 17 is a schematic diagram of a multi-band antenna, according to an embodiment of the present invention.

FIG. 17 is a schematic diagram of a multi-band antenna 1020, according to an embodiment of the present invention. FIG. 17 is a front view of antenna 1020. Antenna 1020 has a rear view substantially similar to the rear view of antenna 20. Apart from the differences described below, the operation of antenna 1020 is generally similar to that of antenna 20 (FIGS. 2A and 2B), and elements indicated by the same reference numerals in both antennas are generally similar in construction and in operation.

In contrast to antenna 20, antenna 1020 comprises one or more elements having non-linear sections. By way of example, a monopole 1022 is generally similar in properties to monopole 30. However, rather than being formed of two orthogonal sections, monopole 1022 is formed as a curved element, resonating at generally the same high-frequency band as monopole 30. Also by way of example, a coupling element 1034 is generally similar in properties to coupling element 34. However, coupling element 1034 comprises a first curved element 1024 which connects two linear elements of the coupling element. Coupling element 1034 also comprises a second curved element 1026 which terminates the coupling element, as well as a third curved element 1028. As shown in FIG. 17, substrate 22 may advantageously be curved at corners of the substrate to conform with curved elements 1024 and 1026.

Figure 18A:
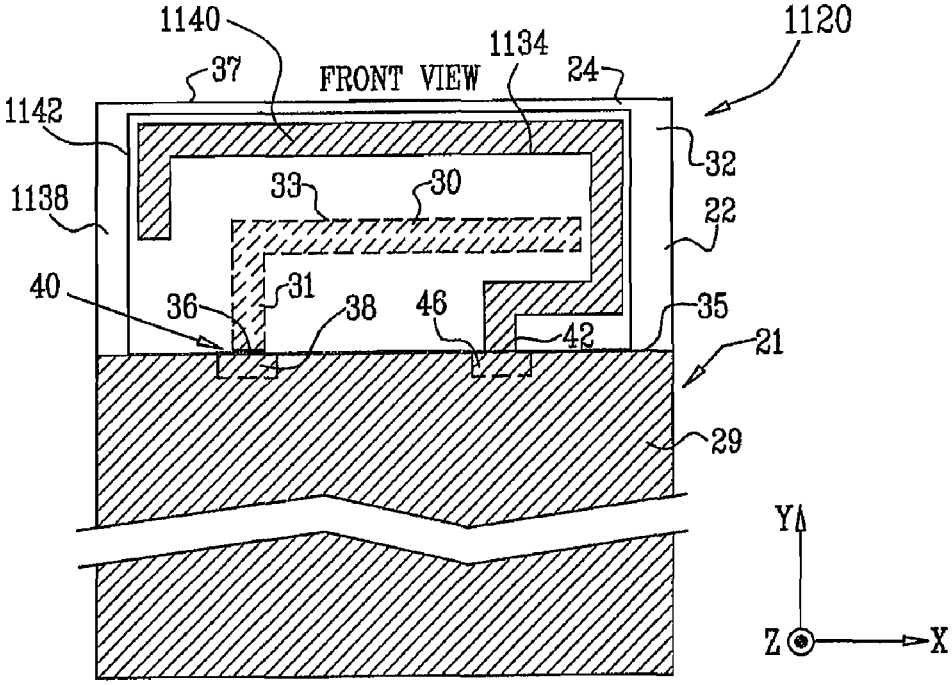
FIGS. 18A and 18B are schematic diagrams of views of a multi-band antenna, according to yet another embodiment of the present invention.
Figure 18B:
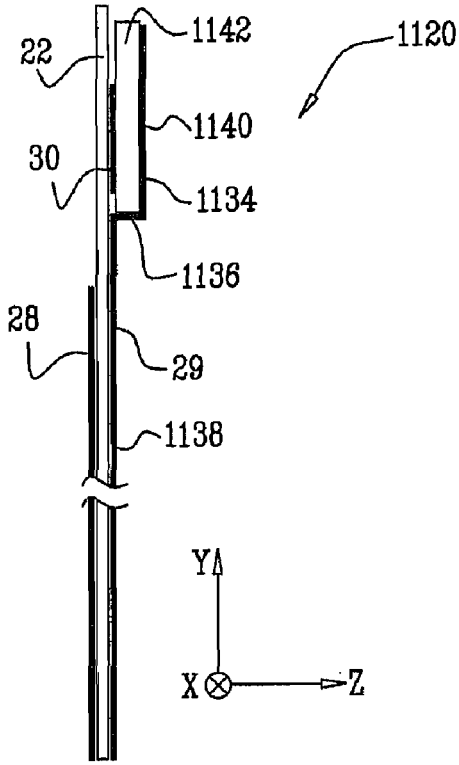

FIGS. 18A and 18B are schematic diagrams of a multi-band antenna 1120, according to an embodiment of the present invention. FIG. 18A is a front view of antenna 1120. FIG. 18B is a side view of the antenna. Antenna 1120 has a rear view substantially similar to the rear view of antenna 20. Apart from the differences described below, the operation of antenna 1120 is generally similar to that of antenna 20 (FIGS. 2A and 2B), and elements indicated by the same reference numerals in both antennas are generally similar in construction and in operation.

In contrast to antenna 20, wherein coupling element 34 is substantially coplanar with monopole 30 and ground plane section 29, antenna 1120 comprises a coupling element 1134 which is not planar and is not coplanar with the monopole and the ground plane section, although coupling element 1134 performs substantially the same functions as element 34. Coupling element 1134 comprises a first section 1136 which is generally orthogonal to a plane 1138 wherein the monopole and the ground plane section lie. Section 1136, typically having a length of the order of 5 mm, is galvanically connected to ground plane section 29 at region 46, and is galvanically connected to a second section 1140 of the coupling element. Second section 1140 is typically supported by a dielectric element 1142, having a plane generally parallel to plane 1138, and coupling element 1134 is configured so that a projection of the element onto plane 1138 folds around monopole 30, and is generally similar in dimensions to coupling element 34.

Figure 19A:
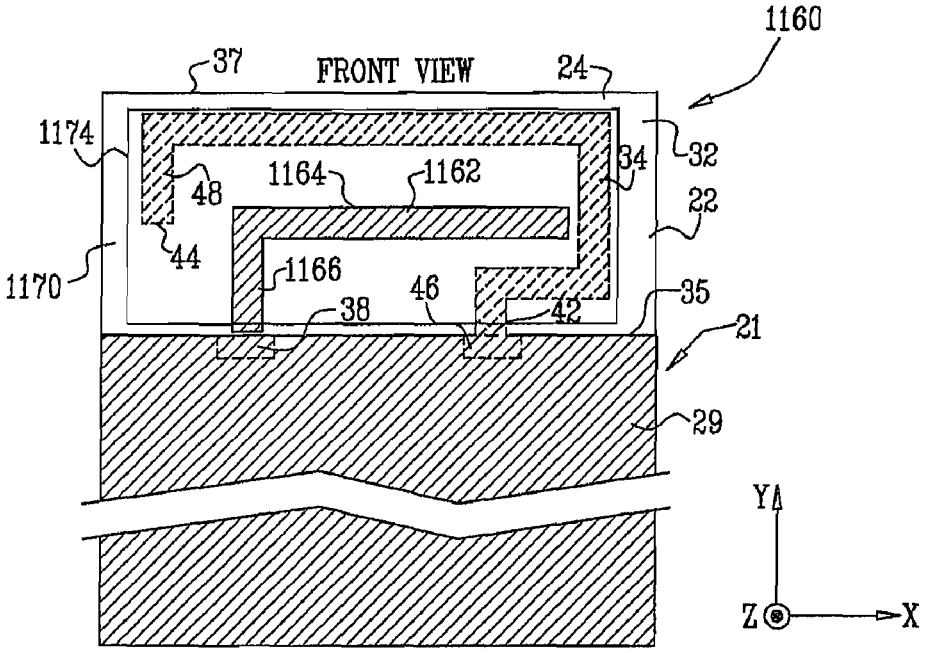
FIGS. 19A and 19B are schematic diagrams of views of a multi-band antenna, according to a yet further embodiment of the present invention.
Figure 19B:
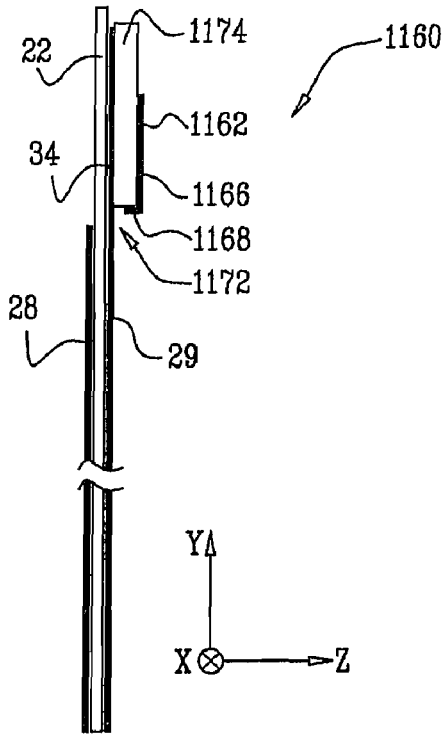

FIGS. 19A and 19B are schematic diagrams of a multi-band antenna 1160, according to an embodiment of the present invention. FIG. 19A is a front view of antenna 1160. FIG. 19B is a side view of the antenna. Antenna 1160 has a rear view substantially similar to the rear view of antenna 20. Apart from the differences described below, the operation of antenna 1160 is generally similar to that of antenna 20 (FIGS. 2A and 2B), and elements indicated by the same reference numerals in both antennas are generally similar in construction and in operation.

In contrast to antenna 20, wherein monopole 30 is substantially coplanar with coupling element 34 and ground plane section 29, antenna 1160 comprises a monopole 1162 which is not planar and is not coplanar with the coupling element and the ground plane section, although monopole 1162, having sections 1164 and 1166 generally similar to sections 33 and 31, performs substantially the same functions as monopole 30. Monopole 1162 comprises a section 1168 which is generally orthogonal to a plane 1170 wherein the coupling element and the ground plane section lie. Section 1168, typically having a length of the order of 4 mm, has a first end which is galvanically connected to section 1166 of the monopole, and a second end which is close to, but does not touch, edge 35, at region 38 of the ground plane, and which couples to the live side of feed 15. There is thus a gap 1172 between the second end of section 1168 and region 38 of ground plane section 29. Monopole 1162 is typically supported by a dielectric element 1174, having a plane generally parallel to plane 1178, and the monopole is configured so that coupling element 34 folds around a projection of the monopole onto plane 1170. The projection is generally similar in dimensions to monopole 30.

Figure 20:
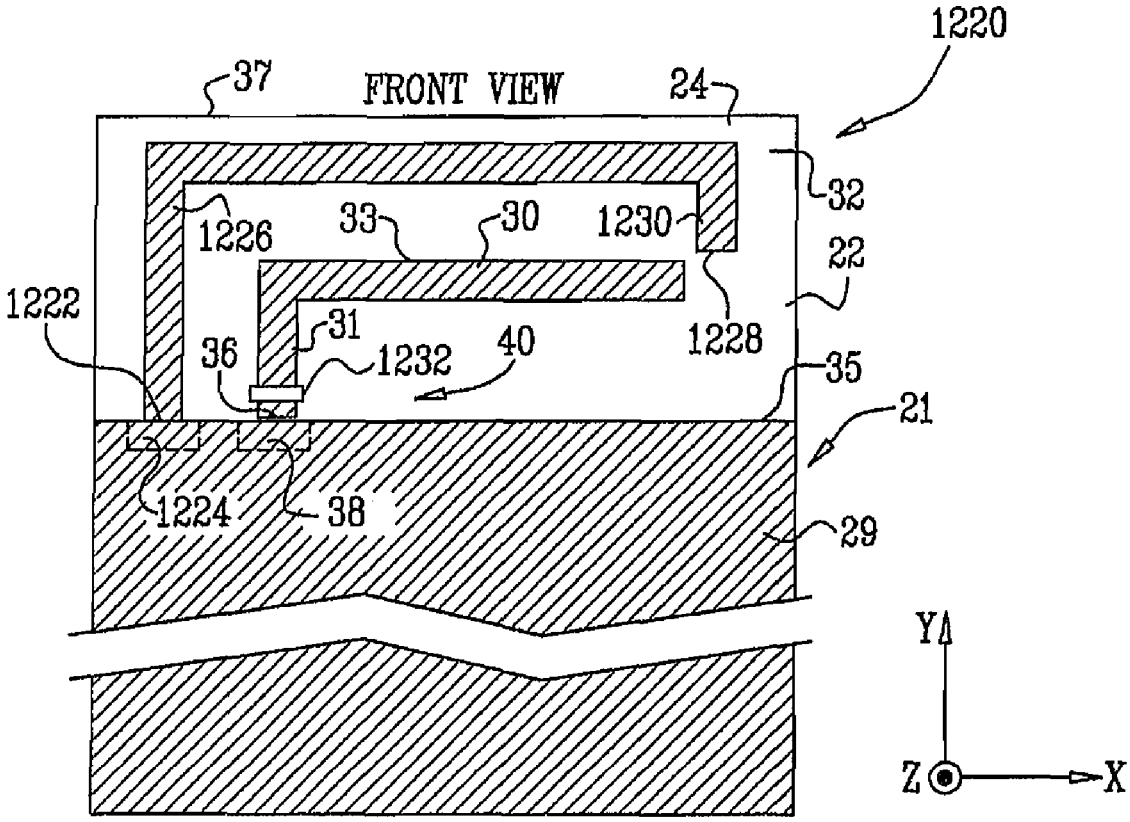
FIG. 20 is a schematic diagram of a multi-band antenna, according to an embodiment of the present invention.

FIG. 20 is a schematic diagram of a multi-band antenna 1220, according to an embodiment of the present invention. FIG. 20 is a front view of antenna 1220. Antenna 1220 has a rear view substantially similar to the rear view of antenna 20. Apart from the differences described below, the operation of antenna 1220 is generally similar to that of antenna 20 (FIGS. 2A and 2B), and elements indicated by the same reference numerals in both antennas are generally similar in construction and in operation.

Antenna 1220 comprises a coupling element 1226, which is generally similar in dimensions to coupling element 34. Thus, element 1226 terminates in a linear section 1230 parallel to the y axis, section 1230 corresponding to section 48 of element 34. Element 1226 has a first end 1222 and a second end 1228, which respectively correspond to ends 42 and 44, and which have generally the same spatial relationship with edge 35 as ends 42 and 44. End 1222 typically galvanically connects to a ground plane coupling region 1224 of edge 35. Region 1224 corresponds to region 46 of antenna 20.

However, in antenna 1220 coupling element 1226 and monopole 30 turn in the same, like, directions as viewed from feed region 38 (for the monopole), and coupling region 1224 (for the coupling element). Thus, taking the feed region and the coupling region as starting points, and viewing from above the x-y plane of antenna 1220, both the monopole and the coupling element turn, or bend, in a clockwise direction.

This is in contrast to the directions of turning of coupling element 34 and monopole 30 in antenna 20. As shown in FIG. 2A, element 34 and monopole 30 turn in opposite directions as viewed from their coupling region and feed region. Thus, taking coupling region 46 and feed region 38 as starting points, and viewing from above the x-y plane, element 34 turns, or bends, in a counter-clockwise direction, but monopole 30 turns in a clockwise direction.

In an alternative embodiment of antenna 1220, a matching circuit 1232 may be added to monopole 30, at a location close to end point 36, so as to alter the effective reactance of the antenna in the low-frequency bands.

It will be understood that combinations of aspects of antennas other than those exemplified above are included in the scope of the present invention. As a first example, one or more inductive elements, generally similar to that described with reference to antenna 120 (FIG. 6), may be incorporated in monopole 330 and/or coupling element 334 of antenna 320 (FIG. 9A), and the dimensions of the monopole or the element may be adjusted correspondingly. As a second example, one or both of coupling elements 34 and 632 of antenna 620 (FIG. 13) may be connected to ground plane 29 via a linear and/or a non-linear indentation, such as those exemplified in antenna 320 (FIG. 9A) and antenna 420 (FIG. 10A). As a third example, one or both of coupling elements 34 and 632 of antenna 620 (FIG. 13) may be positioned on rear surface 26, and ground section 28 removed appropriately, generally as described with regard to antenna 220 (FIGS. 8A and 8B).

As a fourth example, one or both of coupling elements 34 and 632 of antenna 620 may have a section formed along an edge of substrate 22, generally as described with respect to antenna 470 (FIG. 11). As a fifth example, if substrate 22 comprises a multi-layer substrate, each of the separate components of a specific antenna, i.e., the monopole, the one or more coupling elements, and sections of the ground plane, may be formed on different surfaces of the same or different layers. As a sixth example, antennas 1120 and 1160 (FIGS. 18A, 18, 19A, 19B) may be combined, so that both the coupling element and the monopole are in planes which are different from a plane containing the ground plane. Furthermore, the coupling element, the monopole, and the ground plane may comprise three distinct planes. As a seventh example, a matching circuit generally similar to matching circuit 1232 (FIG. 20) may be added to monopole 30 of antenna 20 (FIG. 2A). Other examples of element combinations will be apparent to those skilled in the art. The dimensions in the above embodiments are given solely by way of example and may be adjusted according to the desired operating frequencies of the antenna and other constraints.

It will thus be appreciated that embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. An antenna, comprising:

a planar dielectric substrate;

a conductive ground plane formed on the substrate;

a conductive monopole formed on the substrate and having an end point located in proximity to a feed region of the ground plane; and a conductive coupling element formed on the substrate and coupled to the ground plane at a coupling region of the ground plane, the coupling element being folded around the monopole.

2. The antenna according to claim 1, wherein the conductive monopole has a monopole length, and wherein the conductive coupling element has a coupling element length equal to at least 1.5 times the monopole length.

3. The antenna according to claim 2, wherein the coupling element length is equal to at least two times the monopole length.

4. The antenna according to claim 1, wherein the monopole and the coupling element are configured so that the monopole together with the ground plane radiate with an efficiency of 30% or more in a first frequency band having a first center frequency and in a second frequency band having a second center frequency.

5. The antenna according to claim 4, wherein the first and second frequency bands are disjoint.

6. The antenna according to claim 4, wherein the first frequency band comprises frequencies between 820 MHz and 960 MHz, and wherein the second frequency band comprises frequencies between 1.7 GHz and 2.2 GHz.

7. The antenna according to claim 1, wherein the monopole and the coupling element are configured so that the monopole together with the ground plane radiate with an efficiency of at least 30%.

8. The antenna according to claim 1, wherein the monopole and the coupling element are configured so that the monopole together with the ground plane radiate with an efficiency of at least 30% at a frequency less than or equal to 6 GHz.

9. The antenna according to claim 1, wherein at least one of the conductive monopole and the conductive coupling element comprises a flat strip.

10. The antenna according to claim 1, and comprising one or more reactive elements electrically connected to at least one of the conductive monopole and the conductive coupling element.

11. The antenna according to claim 10, wherein the one or more reactive elements are electrically connected between the conductive coupling element and the ground plane.

12. The antenna according to claim 1, wherein the monopole and the coupling element are formed on opposite surfaces of the substrate.

13. The antenna according to claim 1, wherein the ground plane comprises a first ground plane section formed on a first surface of the substrate and a second ground plane section formed on a second surface of the substrate.

14. The antenna according to claim 1, wherein the ground plane comprises an indentation, and wherein the feed region is located in proximity to the indentation.

15. The antenna according to claim 1, wherein the ground plane comprises an indentation, and wherein a section of the coupling element is disposed within the indentation so as to couple electrically to an end point of the indentation.

16. The antenna according to claim 15, wherein the indentation and the section of the coupling element are linear.

17. The antenna according to claim 15, wherein a length of the indentation and of the section is selected so as to optimize at least one of a reflection coefficient and a radiation efficiency of the antenna at a selected frequency.

18. The antenna according to claim 15, wherein the indentation and the section of the coupling element are non-linear.

19. The antenna according to claim 18, wherein the indentation comprises a first indentation section having a first direction and a second indentation section having a second direction different from the first direction, and wherein the section of the coupling element comprises a first coupling element section disposed within the first indentation section and a second coupling element section disposed within the second indentation section.

20. The antenna according to claim 19, wherein one of the first indentation section and the first coupling element section have a first dimension, and wherein one of the second indentation section and the second coupling element section have a second dimension, and wherein the first and the second dimensions are selected so as to determine a polarization characteristic of radiation from the antenna.

21. The antenna according to claim 1, wherein the coupling element is coupled capacitively to the ground plane.

22. The antenna according to claim 1, wherein the coupling element is coupled galvanically to the ground plane.

23. The antenna according to claim 1, and comprising a further conductive coupling element formed on the substrate and connected to the ground plane at a further coupling region.

24. The antenna according to claim 23, wherein the conductive coupling element has a coupling element length, and wherein the further conductive coupling element has a further coupling element length, and wherein the coupling element length and the further coupling element length are selected so that the coupling element and the further coupling element radiate respectively in a first radiation frequency band and in a second radiation frequency band different from the first radiation frequency band.

25. The antenna according to claim 24, wherein the conductive monopole has a monopole length selected so that the folded monopole acts primarily to couple an electric field to the conductive coupling element and the further conductive coupling element.

26. The antenna according to claim 1, wherein the conductive ground plane, the conductive monopole, and the conductive coupling element are formed on one common surface of the substrate.

27. The antenna according to claim 1, wherein the coupling region and the feed region are in different locations.

28. The antenna according to claim 1, wherein the coupling region and the feed region partly overlap.

29. The antenna according to claim 1, wherein the ground plane comprises a ground plane edge, and wherein at least one of the coupling region and the feed region are in proximity to the ground plane edge.

30. The antenna according to claim 29, wherein at least one of the coupling region and the feed region are at least 3 mm from an end of the edge.

31. The antenna according to claim 1, wherein the ground plane has a ground plane length and the monopole has a monopole length, and wherein a ratio between the monopole length and the ground plane length is in a range between 0.25 and 0.6.

32. The antenna according to claim 1, wherein the monopole comprises a folded monopole.

33. The antenna according to claim 1, wherein the monopole comprises a meander monopole.

34. The antenna according to claim 1, wherein the monopole comprises a linear monopole.

35. The antenna according to claim 1, wherein the ground plane comprises a first edge and a second edge different from the first edge, wherein the feed region is formed in proximity to the first edge and wherein the coupling region is formed in proximity to the second edge.

36. The antenna according to claim 35, wherein the coupling element comprises a linear element having a dimension selected so as to determine a polarization characteristic of radiation from the antenna.

37. The antenna according to claim 1, wherein the dielectric substrate comprises a plurality of dielectric layers, and wherein at least two of the ground plane, the monopole, and the coupling element are formed on different layers comprised in the dielectric layers.

38. The antenna according to claim 1, wherein the monopole comprises a single-band monopole.

39. The antenna according to claim 1, wherein the monopole comprises a multi-band monopole.

40. The antenna according to claim 1, wherein the coupling element comprises a further coupling element galvanically connected to the coupling element and capacitively coupling to a further coupling region of the ground plane.

41. The antenna according to claim 1, wherein the monopole as viewed from the feed region and the coupling element as viewed from the coupling region are configured to turn in opposite directions.

42. The antenna according to claim 1, wherein the monopole as viewed from the feed region and the coupling element as viewed from the coupling region are configured to turn in like directions.

43. The antenna according to claim 1, wherein the end point is configured to couple to a live side of a feed to the antenna.

44. The antenna according to claim 1, and comprising a matching circuit coupled to the conductive monopole and located in proximity to the end point.

45. A method for producing an antenna, comprising:

providing a planar dielectric substrate;

forming a conductive ground plane on the substrate;

forming a conductive monopole on the substrate, the monopole having an end point located in proximity to a feed region of the ground plane;

forming a conductive coupling element on the substrate;

coupling the conductive coupling element to the ground plane at a coupling region of the ground plane; and folding the coupling element around the monopole.

46. The method according to claim 45, wherein the conductive monopole has a monopole length, and wherein the conductive coupling element has a coupling element length equal to at least 1.5 times the monopole length.

47. The method according to claim 45, and comprising configuring the monopole and the coupling element so that the monopole together with the ground plane radiate with an efficiency of 30% or more in a first frequency band having a first center frequency and in a second frequency band having a second center frequency.

48. The method according to claim 45, wherein the ground plane comprises an indentation, the method comprising disposing a section of the coupling element within the indentation so as to couple electrically to an end point of the indentation.

49. The method according to claim 45, and comprising forming a further conductive coupling element on the substrate and connecting the further conductive coupling element to the ground plane at a further coupling region.

50. An antenna, comprising:

a dielectric substrate;

a conductive ground plane formed on the substrate and having a first edge and a second edge;

a first conductive monopole formed on the substrate and having a first end point located in proximity to the first edge;

a first conductive coupling element formed on the substrate and coupled to the ground plane at a first coupling region of the ground plane, the first coupling element being folded around the first monopole;

a second conductive monopole formed on the substrate and having a second end point located in proximity to the second edge; and a second conductive coupling element formed on the substrate and coupled to the ground plane at a second coupling region of the ground plane, the second coupling element being folded around the second monopole.

51. The antenna according to claim 50, wherein the ground plane, the first monopole, and the first coupling element are configured to operate at a first frequency, and wherein the ground plane, the second monopole, and the second coupling element are configured to operate at a second frequency different from the first frequency.

52. The antenna according to claim 50, wherein the ground plane, the first monopole, and the first coupling element, are configured to operate at a given frequency, and wherein the ground plane, the second monopole, and the second coupling element are configured to operate at the given frequency.

53. A method for producing an antenna, comprising:

providing a dielectric substrate;

forming a conductive ground plane having a first edge and a second edge on the substrate;

forming a first conductive monopole on the substrate, the first monopole having a first end point located in proximity to the first edge;

forming a first conductive coupling element on the substrate;

coupling the first conductive coupling element to the ground plane at a first coupling region of the ground plane;

folding the first coupling element around the first monopole;

forming a second conductive monopole on the substrate, the monopole having a second end point located in proximity to the second edge;

forming a second conductive coupling element on the substrate;

coupling the second conductive coupling element to the ground plane at a second coupling region of the ground plane; and folding the second coupling element around the second monopole.

54. An antenna, comprising:

a planar dielectric substrate;

a conductive ground plane formed on the substrate and having a ground plane edge;

a conductive monopole formed on the substrate in proximity to the ground plane edge and having an end point located in proximity to a feed region of the ground plane; and a conductive coupling element formed on the substrate in proximity to the ground plane edge and coupled to the ground plane at a coupling region of the ground plane, the coupling element being configured so that a portion of the conductive monopole lies between a section of the element and the ground plane edge.

55. The antenna according to claim 54, wherein the feed region and the coupling region comprise respective sections of the ground plane edge.

56. The antenna according to claim 54, wherein at least one of the sections is at least 3 mm from an end of the edge.

57. A communication device, comprising:

a transceiver; and an antenna coupled to the transceiver, the antenna comprising:

a planar dielectric substrate;

a conductive ground plane formed on the substrate;

a conductive monopole formed on the substrate and having an end point located in proximity to a feed region of the ground plane; and a conductive coupling element formed on the substrate and coupled to the ground plane at a coupling region of the ground plane, the coupling element being folded around the monopole.

58. A method for producing a communication device, comprising:

providing a transceiver; and coupling an antenna to the transceiver, the antenna comprising:

a planar dielectric substrate, a conductive ground plane formed on the substrate, a conductive monopole formed on the substrate and having an end point located in proximity to a feed region of the ground plane, and a conductive coupling element formed on the substrate and coupled to the ground plane at a coupling region of the ground plane, the coupling element being folded around the monopole.

59. An antenna, comprising:

a planar dielectric substrate;

a conductive ground plane formed on the substrate;

a conductive loop formed on the substrate and having an end point located in proximity to a feed region of the ground plane; and a conductive coupling element formed on the substrate and coupled to the ground plane at a coupling region of the ground plane, the coupling element being folded around the loop.

60. A method for producing an antenna, comprising:

providing a planar dielectric substrate;

forming a conductive ground plane on the substrate;

forming a conductive loop on the substrate, the loop having an end point located in proximity to a feed region of the ground plane; and forming a conductive coupling element on the substrate and coupling the coupling element to the ground plane at a coupling region of the ground plane so that the coupling element folds around the loop.

61. An antenna, comprising:

a planar dielectric substrate;

a conductive ground plane formed on the substrate;

a conductive monopole having an end point located in proximity to a feed region of the ground plane; and a conductive coupling element coupled to the ground plane at a coupling region of the ground plane, at least one of the conductive monopole and the conductive coupling element having a section external to a plane of the substrate, a projection of the coupling element onto the plane being folded around a projection of the monopole onto the plane.

62. A method for producing an antenna, comprising:

providing a planar dielectric substrate;

forming a conductive ground plane on the substrate;

forming a conductive monopole having an end point located in proximity to a feed region of the ground plane; and coupling a conductive coupling element to the ground plane at a coupling region of the ground plane, at least one of the conductive monopole and the conductive coupling element having a section external to a plane of the substrate, a projection of the coupling element onto the plane being folded around a projection of the monopole onto the plane.

63. An antenna, comprising:

a planar dielectric substrate;

a conductive ground plane formed on the substrate and operative as a parallel resonant circuit having a first resonance frequency;

a conductive coupling element, operative as a series resonant circuit having the first resonance frequency, and located in proximity to the conductive ground plane so as to be coupled thereto by a first field chosen from at least one of a first electric field and a first magnetic field; and a conductive monopole, operative as a series resonant circuit having a second resonance frequency, and located in proximity to the conductive coupling element so as to be coupled thereto by a second field chosen from at least one of a second electric field and a second magnetic field.

64. The antenna according to claim 63, wherein a first electric coupling generated by the first electric field is greater than a first magnetic coupling generated by the first magnetic field, and wherein a second electric coupling generated by the second electric field is greater than a second magnetic coupling generated by the second magnetic field.

65. The antenna according to claim 63, wherein the conductive monopole and the conductive ground plane are coupled by a third field chosen from at least one of a third electric field and a third magnetic field.

66. A method for producing an antenna, comprising:

providing a planar dielectric substrate;

forming a conductive ground plane on the substrate, the conductive ground plane being operative as a parallel resonant circuit having a first resonance frequency;

locating a conductive coupling element, operative as a series resonant circuit having the first resonance frequency, in proximity to the conductive ground plane so as to be coupled thereto by a first field chosen from at least one of a first electric field and a first magnetic field; and locating a conductive monopole, operative as a series resonant circuit having a second resonance frequency, in proximity to the conductive coupling element so as to be coupled thereto by a second field chosen from at least one of a second electric field and a second magnetic field.

* * * * *